US009801432B2

(12) United States Patent
Kataguchi et al.

(10) Patent No.: US 9,801,432 B2
(45) Date of Patent: Oct. 31, 2017

(54) BUCKLE

(75) Inventors: Ryoko Kataguchi, Toyama (JP); Hitoshi Kaneko, Toyama (JP); Tomoko Yagami, Tokyo (JP)

(73) Assignee: YKK Corporation (JP)

( * ) Notice: Subject to any disclaimer, the term of this patent is extended or adjusted under 35 U.S.C. 154(b) by 21 days.

(21) Appl. No.: 14/401,564

(22) PCT Filed: May 25, 2012

(86) PCT No.: PCT/JP2012/063534
§ 371 (c)(1),
(2), (4) Date: Nov. 17, 2014

(87) PCT Pub. No.: WO2013/175634
PCT Pub. Date: Nov. 28, 2013

(65) Prior Publication Data
US 2015/0135494 A1 May 21, 2015

(51) Int. Cl.
*A44B 11/26* (2006.01)

(52) U.S. Cl.
CPC ..... *A44B 11/266* (2013.01); *Y10T 24/45524* (2015.01); *Y10T 24/45529* (2015.01); *Y10T 24/45958* (2015.01)

(58) Field of Classification Search
CPC ..... A44B 11/266; Y10T 24/45958
See application file for complete search history.

(56) References Cited

U.S. PATENT DOCUMENTS 7,320,160 B2 * 1/2008 Uehara ..... A44B 11/266 24/614
9,232,833 B2 * 1/2016 Paik ..... A44B 11/263
2001/0032379 A1 * 10/2001 Chang ..... A44B 11/266 24/614

(Continued)

FOREIGN PATENT DOCUMENTS

JP 2006-129952 A 5/2006
JP 3142924 U 7/2008

(Continued)

OTHER PUBLICATIONS

International Preliminary Report on Patentability, PCT Application No. PCT/JP2012/063534, dated Nov. 25, 2014.

(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

A buckle with an enhanced efficiency in removing a foreign substance is provided. The buckle includes: a plug; and a socket provided with an insertion opening into which the plug is to be inserted. The socket includes: a pair of front pieces disposed side by side in a width direction intersecting with an insertion direction of the plug; a back piece disposed to face each of the front pieces; and a bottom piece that connects each of the front pieces and the back piece. A slit defined between the pair of front pieces extends in the insertion direction from the insertion opening across the (Continued)

bottom piece and the front pieces of the socket. Due to the presence of the slit, a cross section of the socket intersecting with the insertion direction is in a C-shape.

11 Claims, 18 Drawing Sheets

(56) References Cited

U.S. PATENT DOCUMENTS

| | | | | |
|---|---|---|---|---|
| 2008/0178438 | A1 | 7/2008 | Yoshie | |
| 2009/0056089 | A1* | 3/2009 | Yoshie | A44B 11/266 24/616 |
| 2013/0312233 | A1* | 11/2013 | Paik | A44B 11/266 24/594.1 |

FOREIGN PATENT DOCUMENTS

| | | | |
|---|---|---|---|
| JP | 2008-178570 | A | 8/2008 |
| WO | 2010/113368 | A1 | 10/2010 |

OTHER PUBLICATIONS

International Search Report, PCT Application No. PCT/JP2012/063534, dated Jul. 31, 2012.
Office Action, German Patent Application No. 11 2012 006 425.9, dated Jul. 13, 2017.

* cited by examiner

BUCKLE

This application is a national stage application of PCT/JP2012/063534, which is incorporated herein by reference.

TECHNICAL FIELD

The present invention relates to a buckle that fastens belts to each other or a belt to a different article. In particular, the present invention relates to a side release buckle including a pair of lock arms.

BACKGROUND ART

Typically, a buckle including a plug and a socket that are detachably connectable to each other is used in various use applications to fasten string members of belts or the like to each other or to fasten a belt or the like to a different article such as a bag body.

Such a buckle should be capable of being easily attached/detached and being reliably kept in a connected state (i.e., the basic functions of the buckle) and, further, is desired to be improved in a guiding function required during a connecting operation and be reduced in overall weight.

A buckle disclosed in Patent Literature 1 is a side release buckle that basically includes a plug and socket, each of which includes a belt attachment. The plug also includes a pair of lock arms provided with engagement portions, which are engaged with the socket at an inside of the socket, so that the plug is connected to the socket.

The socket also includes a body in the form of a hollow cylinder. The body has a plug-opposed end provided with an insertion opening and lateral sides each provided with an operation opening. The lock arms of the plug are inserted into the socket through the insertion opening and the engagement portions are engaged. The lock arms are partially exposed from the operation opening in a connected state so that a user can clasp the exposed parts of the lock arms and move them to disengage the engagement portions.

In particular, the buckle disclosed in Patent Literature 1 includes a guide bar disposed between the pair of lock arms of the plug to stabilize a posture of the plug (i.e., improve the guiding function) during the insertion of the plug into the socket.

The guide bar is to be received in the socket. Alternatively, a socket body of the socket may be provided with a V-shaped or Y-shaped cut formed in conformity with the guide bar so that the guide bar of the plug is fitted in the cut of the socket when the plug is connected to the socket. Such a cut of the socket contributes to preventing an increase in a thickness of the buckle and reducing a weight of the buckle.

A bucket disclosed in Patent Literature 2 includes a guiding arrangement provided to an internal surface of a socket to ensure the guiding function. Further, the buckle has two small-sized guide bars and enlarged cuts in the socket body, thereby further reducing the weight of the buckle.

CITATION LIST

Patent Literature(s)

Patent Literature 1: JP-A-2006-129952

Patent Literature 2: WO 2010/113368

SUMMARY OF THE INVENTION

Problem(s) to be Solved by the Invention

As described above, the socket of the typical buckle is provided with the cut to reduce the weight of the buckle.

The cut of the socket has been found helpful in removing a foreign substance entering the socket.

However, while increasing an area where an inner space of the cavity is in communication with the outside of the buckle, the cut, the operation opening and the insertion opening fail to sufficiently improve the typical buckle in terms of efficiency in removing a foreign substance.

Specifically, the socket of the typical buckle is in a cylindrical shape basically continuous in a plug-insertion direction and has a cross section partially annularly continuous. Incidentally, since the typical buckle is to be attached to a belt or the like and is accordingly shaped flat, the socket is in a flat cylindrical shape.

Specifically, the socket body includes: a plate-shaped front piece; a plate-shaped back piece opposed to the front piece; and lateral pieces that connect the front and back pieces into a flat cylindrical shape. The cylindrical socket body has a first end provided with an opening serving as the insertion opening and a second end that is opposite to the first end and provided with a bottom plate as needed. The bottom plate is provided with a drain port as needed. The operation opening is provided in a middle of each of the lateral surfaces and is widened by cutting the front and back pieces as needed.

The above cut for weight reduction is provided to each or one of the front and back pieces to be continuous from the insertion opening or the bottom plate. It should be noted that it is necessary for defining the cylindrical shape that the front piece and the back piece be connected to each other by the opposite pair of lateral pieces so that the socket body partially has an annular cross section.

However, due to the necessity of such a basic arrangement of the socket, efficiency in removing a foreign substance entering the socket cannot be enhanced even when the cut is widened to the front or back piece.

An object of the invention is to provide a buckle provided with an enhanced efficiency in removing a foreign substance.

Means for Solving the Problem(s)

According to an aspect of the invention, a buckle includes: a plug; and a socket provided with an insertion opening into which the plug is to be inserted, the socket including: a pair of front pieces disposed side by side in a width direction intersecting with an insertion direction of the plug; a back piece disposed to face each of the front pieces; and a bottom piece disposed opposite to the insertion opening to connect the front pieces and the back piece, in which a slit is defined between the pair of front pieces, and the slit extends in the insertion direction from the insertion opening across the bottom piece and the front pieces of the socket.

In the above aspect, the socket is provided with the slit on a side where the front pieces are provided and the slit extends in the insertion direction longitudinally across the socket. The slit thus serves to enhance efficiency in removing a foreign substance.

For instance, when a foreign substance enters the socket through the insertion opening while the plug and the socket are disconnected, the foreign substance may be swept out of the socket along the slit over the entire length in the insertion direction with a finger or a stick inserted in the slit.

A typical cylindrical socket is not provided with such a slit extending along the entire length in the insertion direction, so that a foreign substance should be swept out in a restricted manner. In contrast, the socket according to the above aspect is provided with the slit extending along the entire length in the insertion direction, so that a foreign substance can be easily and reliably swept out of the entire socket.

Further, in the above aspect, due to the presence of the slit extending along the entire length in the insertion direction, the socket may be shortened in the insertion direction and the plug may accordingly be shortened, thereby further reducing the weight and the size of the buckle.

In the above aspect, it is preferable that the plug include: a base; and a pair of lock arms that extend in the insertion direction from the base and each include an engagement portion, the socket define a cavity provided between the front pieces and the back piece and configured to receive the lock arms therein, and the socket further include engaged portions provided to the front pieces and the back piece, the engaged portions each being engageable with the engagement portion.

In the above aspect, the pair of lock arms can thus be received in the cavity between the front pieces and the back piece. Therefore, the invention is suitably applicable to a side release buckle including a pair of lock arms.

In the above aspect, it is preferable that the socket further include at least a pair of lateral pieces provided to opposite sides of the socket defined in the width direction to connect the front pieces and the back piece, the lateral pieces being continuous in the insertion direction.

In the above aspect, the lateral pieces on opposite lateral sides thus serve to reliably connect the front pieces to the back piece. Further, the socket, which includes the front pieces, the back piece and the lateral pieces, has a C-shaped cross section at any position defined in the insertion direction, the C-shaped cross section intersecting with the insertion direction of the socket. Therefore, the plug can be inserted without any interference and a foreign substance can be reliably swept through the slit.

In the above aspect, it is preferable that the bottom piece be provided with a cut that is continuous with the slit, and the cut divide the bottom piece in the width direction into two parts, the two parts being connected to each other by a portion erected from the back piece.

In the above aspect, the bottom piece of the socket has a side near the back piece and including a portion erected from the back piece. The erected portion is in the form of a rib continuous in the width direction of the socket along the back piece.

For instance, when the bottom piece is provided along the entire length in the width direction of the socket and a side of the bottom piece near the front pieces is provided with a cut continuous with the slit to halve the bottom piece, a portion not removed to form the cut is in the form of the rib erected from the bottom piece. The front pieces provided side by side to the socket and the halved bottom piece are connected to one another by the portion in the form of the rib and the bottom piece, which are disposed in mutually intersecting direction to enhance the rigidity of a connecting arrangement (i.e., the rigidity of the bottom piece of the socket).

In the above aspect, it is preferable that the plug further include a guide bar that extends in the insertion direction, and the front pieces each have a peripheral portion that faces the slit to function as a guide abutting against the guide bar.

In the above aspect, the peripheral portion of each of the front pieces thus also functions as a guiding arrangement during insertion of the plug without necessitating any other guiding arrangement or the like, which results in further simplification of the structure of the socket and reduction in the weight of the socket.

In the above aspect, it is preferable that the peripheral portion of each of the front pieces be flared toward the insertion opening.

In the above aspect, the plug can thus be easily inserted through the insertion opening due to a favorable guiding function.

In the above aspect, it is preferable that when the guide bar is received in the slit, a surface of the guide bar define a continuous surface in combination with a surface of each of the front pieces.

In the above aspect, while providing the guiding function as described above, the guide bar closes the slit when the plug and the socket are connected to improve the appearance of the buckle.

In the above aspect, it is preferable a step to be engaged with the peripheral portion of each of the front pieces be provided to a peripheral portion of the surface of the guide bar.

In the above aspect, while the guide bar provides the guiding function to connect the plug and the socket as described above, the step of the guide bar is fitted on the peripheral portion of each of the front pieces defined along the slit when the plug and the socket are connected. Therefore, for instance, when an external force such as a bending force acts between the plug and the socket, the mutually fitted step and peripheral portion exhibit resistivity to such an external force to enhance a bending rigidity, thereby effectively preventing the buckle from being accidentally unlocked.

According to another aspect of the invention, a buckle includes: a plug; and a socket provided with an insertion opening into which the plug is to be inserted and a slit that extends in an insertion direction of the plug longitudinally across the socket, in which a cross section of the socket intersecting with the insertion direction is in a C-shape.

In the above aspect, the socket (i.e., a socket body excluding a belt attachment and the like) is provided with the slit extending longitudinally thereacross, so that a cross section of the socket is not in a cylindrical shape but is in a C-shape. As a result, the above advantageous effects of the invention attributed to the C-shaped cross section can be achieved.

BRIEF DESCRIPTION OF DRAWING(S)

FIG. 1 is a perspective view showing a disconnected state according to an exemplary embodiment of the invention.

FIGS. 2(A) to (C) are respectively a plan view, a side view and a bottom view, showing a plug according to the exemplary embodiment.

FIGS. 3(A) to (C) are respectively a plan view, a side view and a bottom view, showing a socket according to the exemplary embodiment.

FIGS. 7(A) and (B) are respectively a side view and a sectional view, showing that the plug and the socket according to the exemplary embodiment are to be connected.

FIGS. 8(A) and (B) are respectively a side view and a sectional view, showing that the plug and the socket according to the exemplary embodiment are connected.

Figure 9:
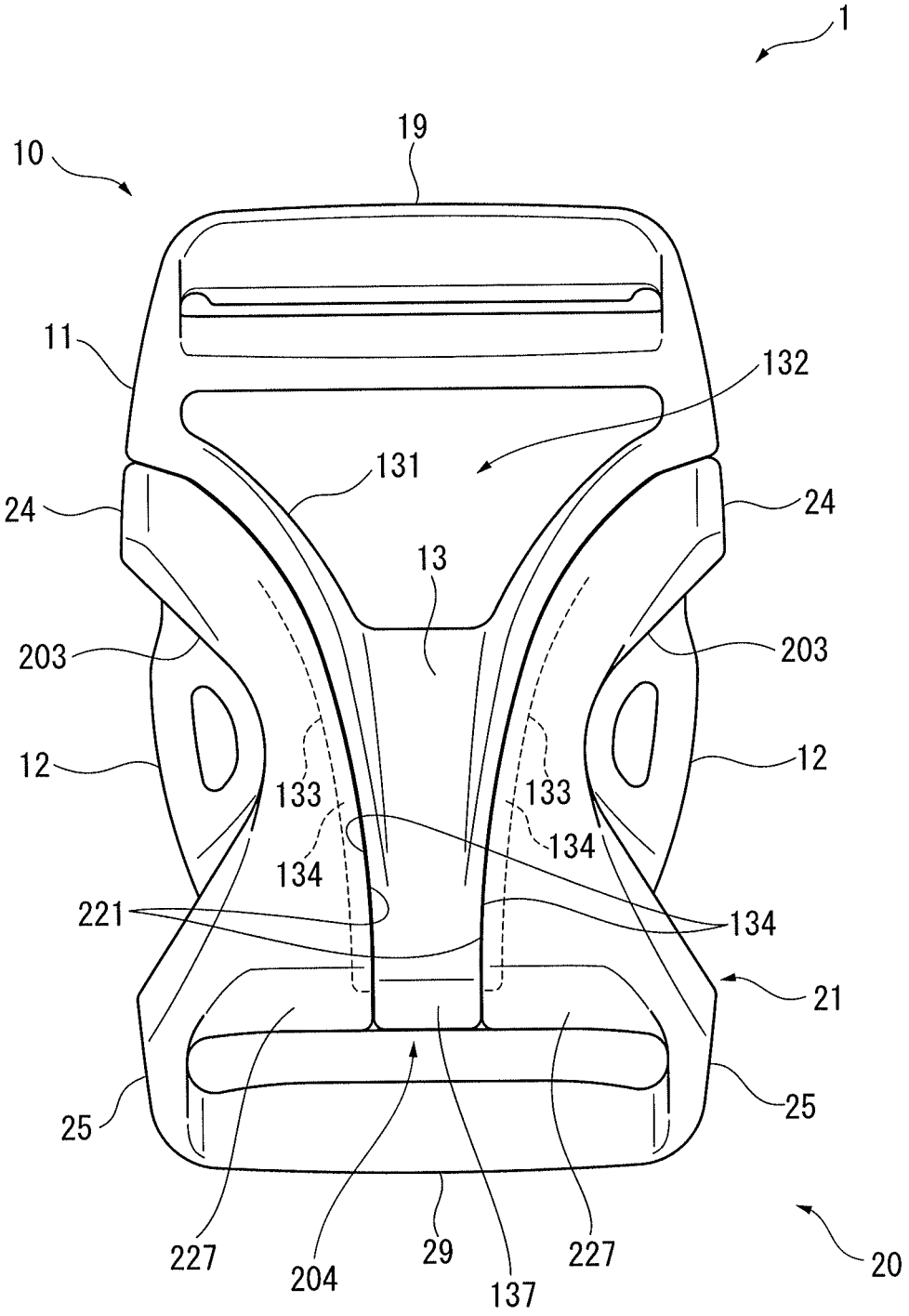

FIG. 9 is a plan view showing that the plug and the socket according to the exemplary embodiment are connected.

Figure 10:
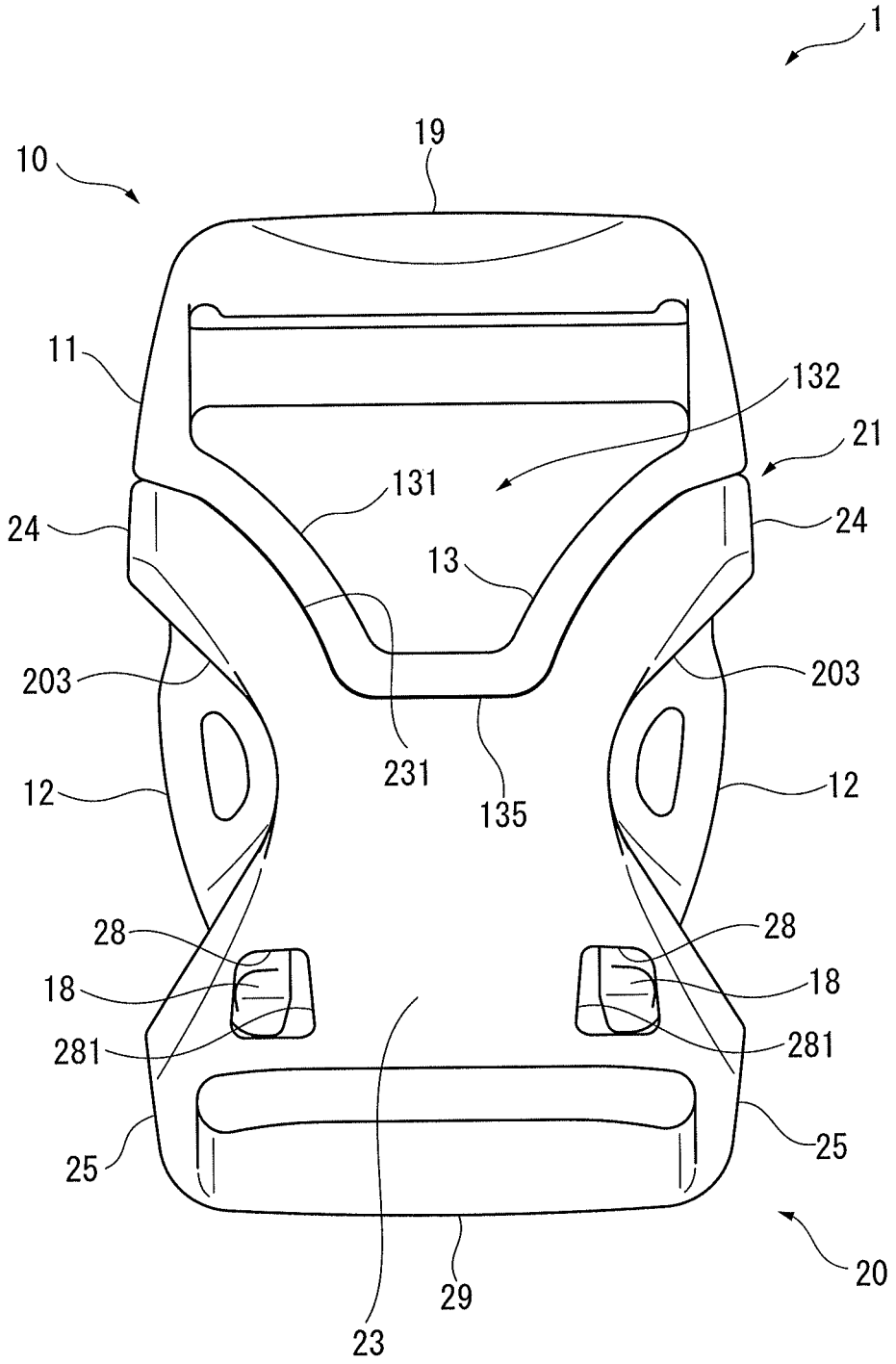

FIG. 10 is a bottom view showing that the plug and the socket according to the exemplary embodiment are connected.

FIGS. 11(A) and (B) are respectively a side view and a sectional view, showing that the plug and the socket according to the exemplary embodiment are to be connected after flipped over.

FIGS. 12(A) and (B) are respectively a side view and a sectional view, showing that the plug and the socket according to the exemplary embodiment are connected after flipped over.

Figure 13:
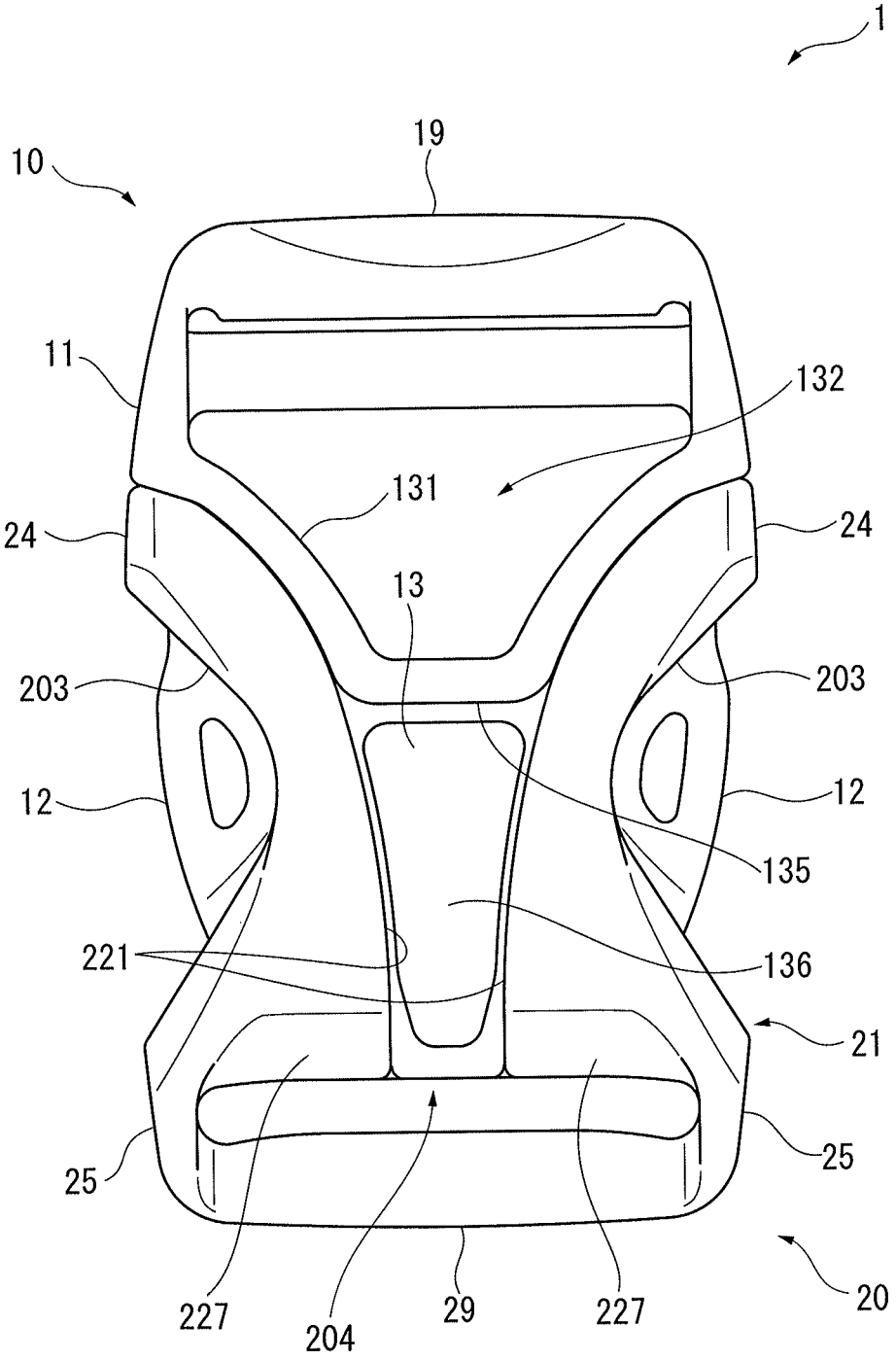

FIG. 13 is a plan view showing that the plug and the socket according to the exemplary embodiment are connected after flipped over.

Figure 14:
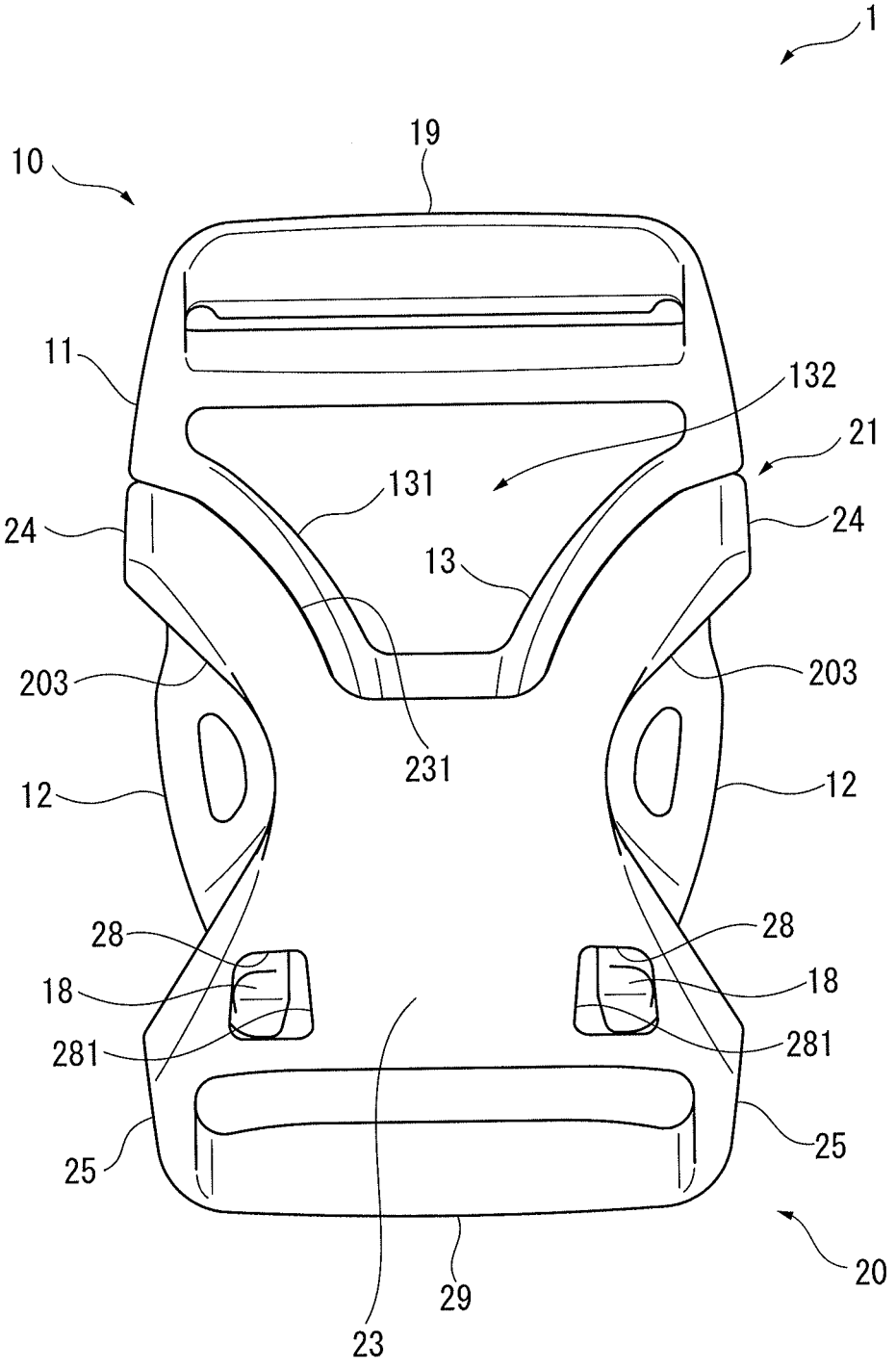

FIG. 14 is a bottom view showing that the plug and the socket according to the exemplary embodiment are connected after flipped over.

Figure 15:
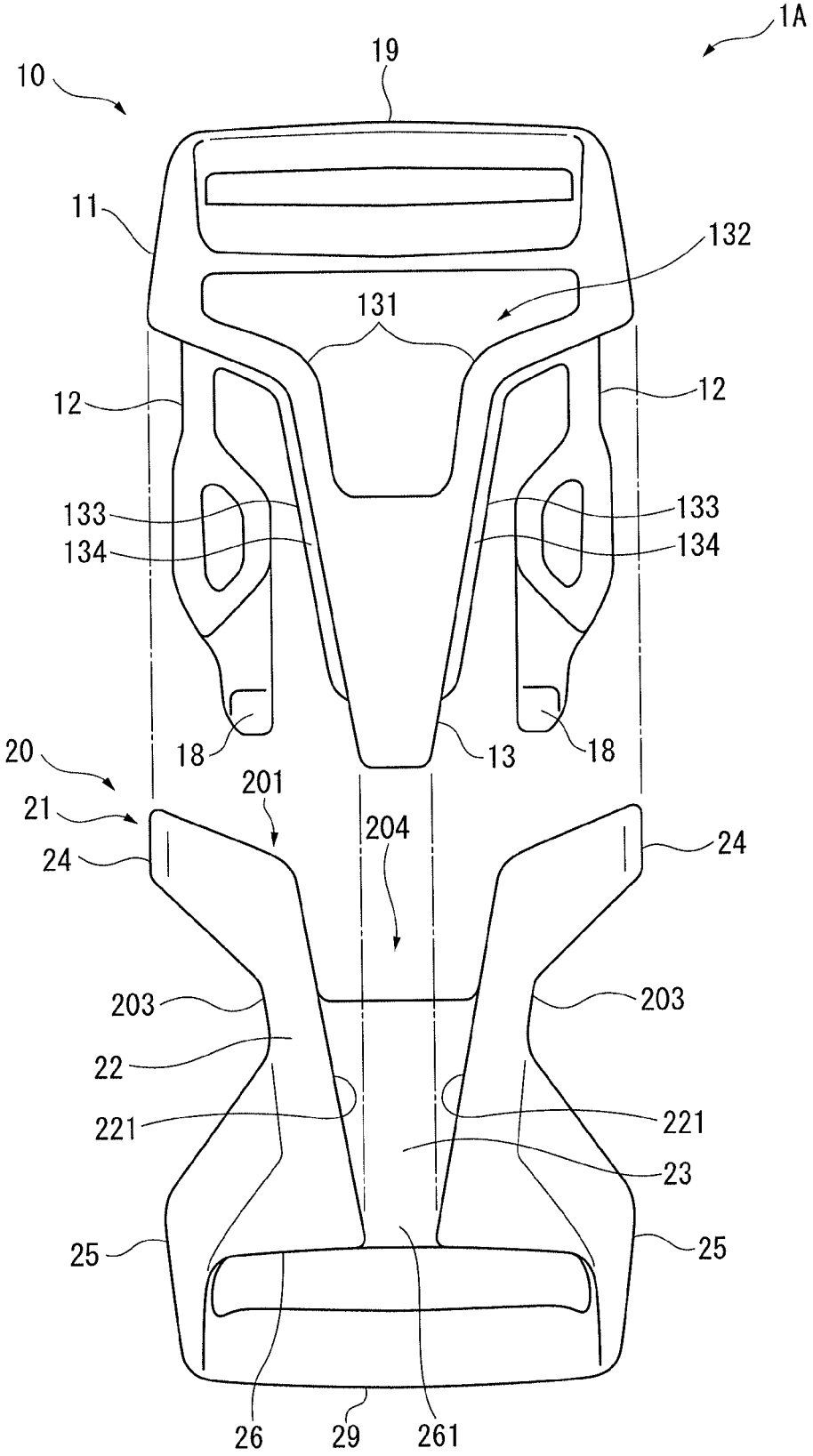

FIG. 15 is a plan view showing a disconnected state according to another exemplary embodiment of the invention.

Figure 16:
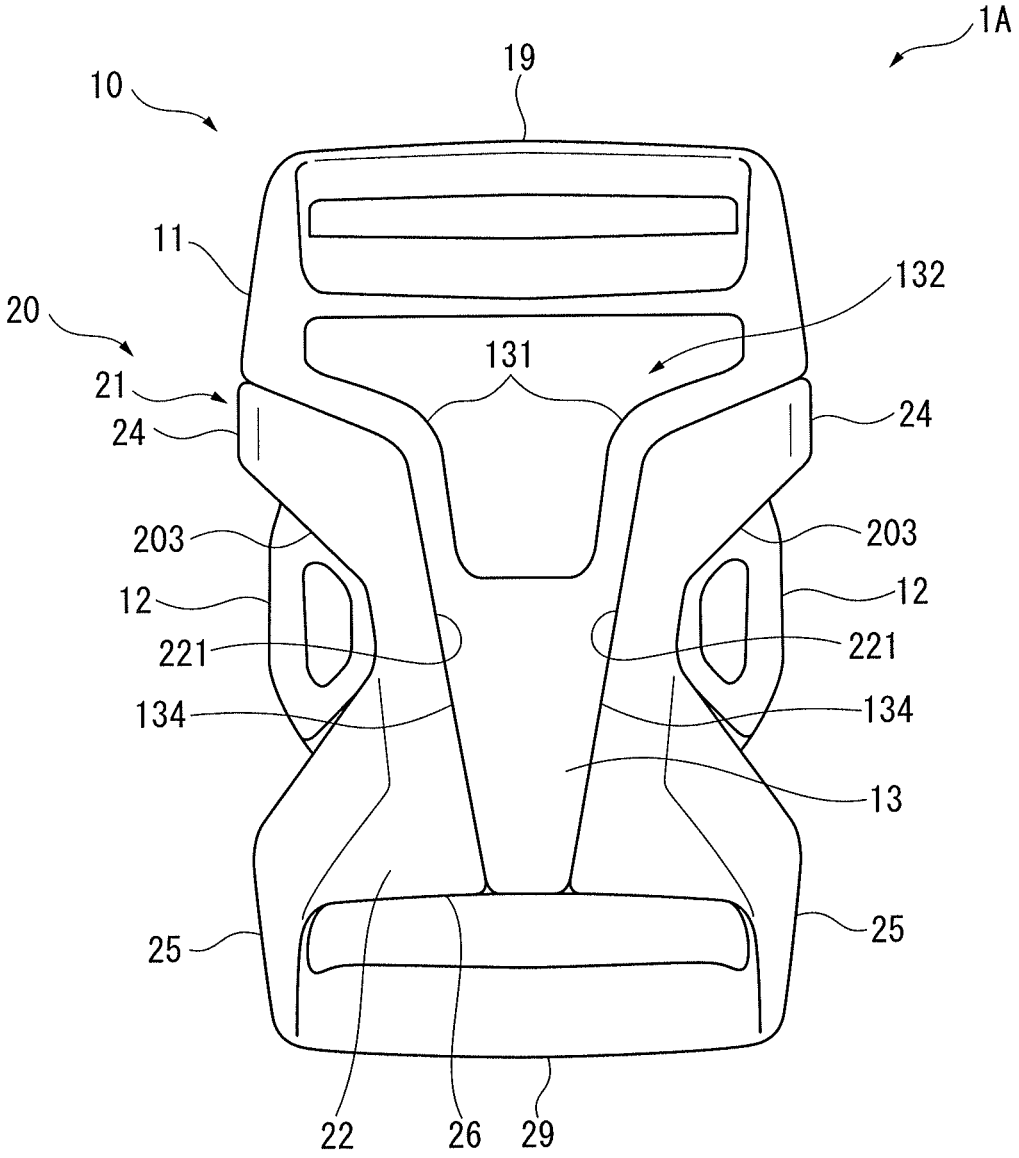

FIG. 16 is a plan view showing a connected state according to the exemplary embodiment shown in FIG. 15.

Figure 17:
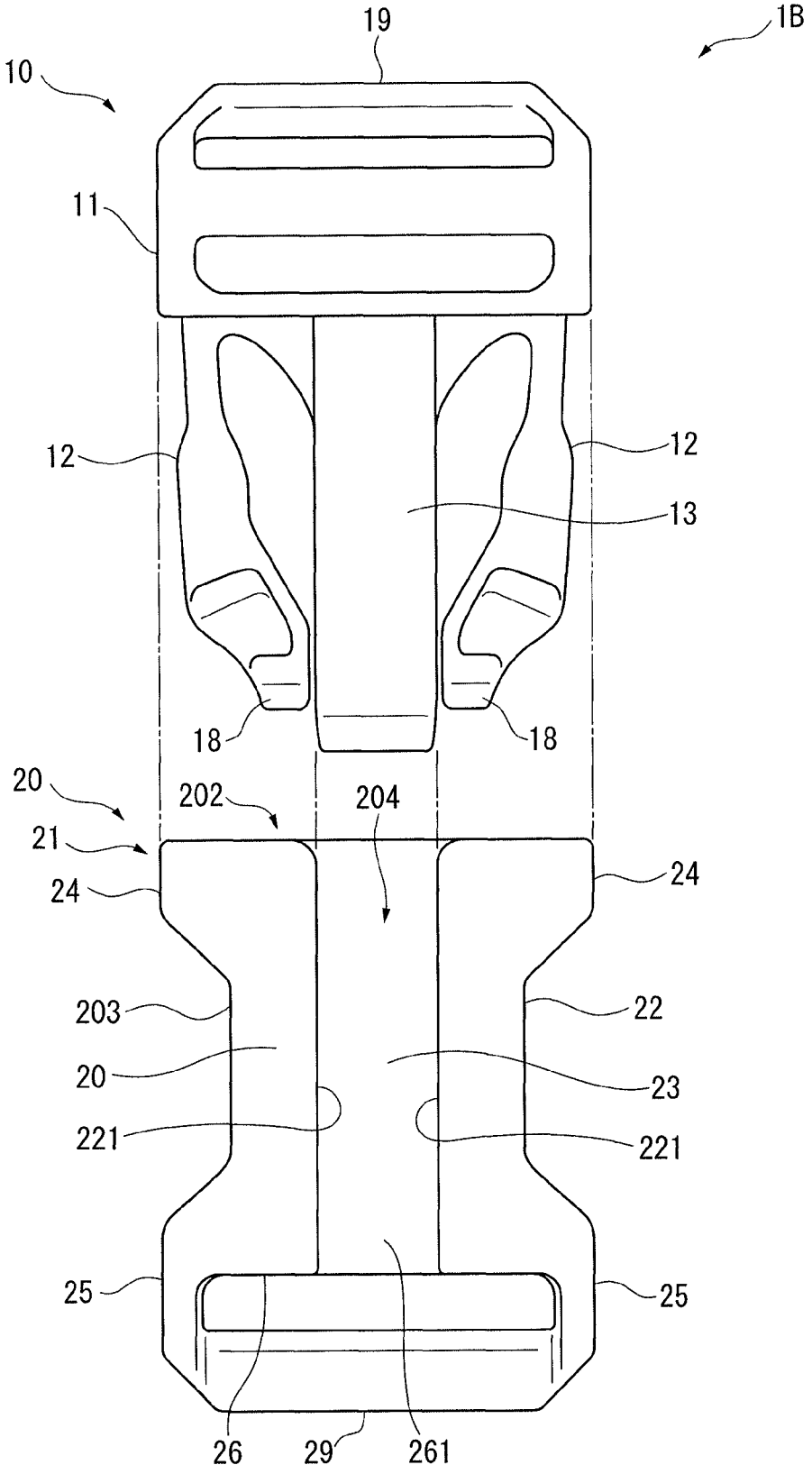

FIG. 17 is a plan view showing a disconnected state according to still another exemplary embodiment of the invention.

Figure 18:
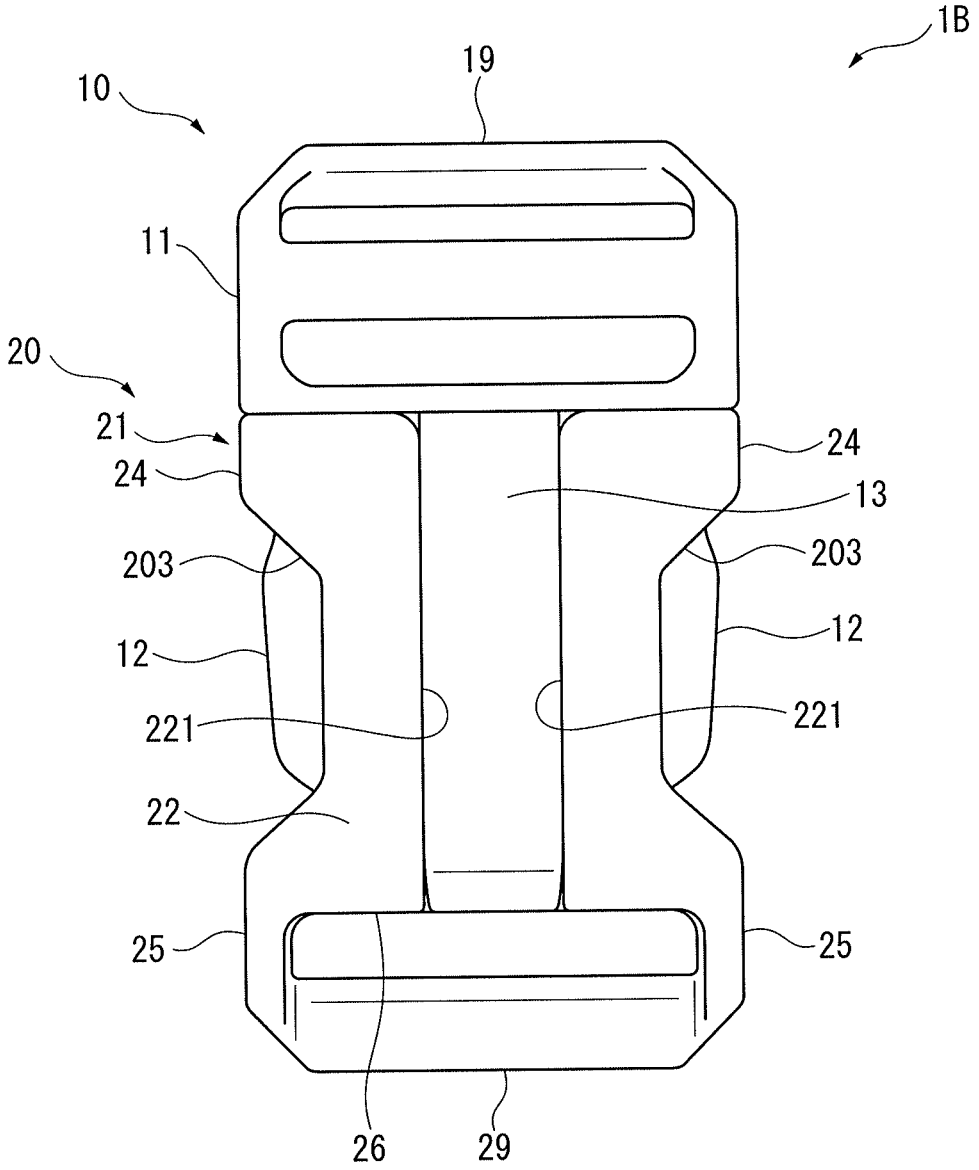

FIG. 18 is a plan view showing a connected state according to the exemplary embodiment of FIG. 17.

DESCRIPTION OF EMBODIMENT(S)

An exemplary embodiment of the invention will be described below with reference to the attached drawings.

Figure 1:
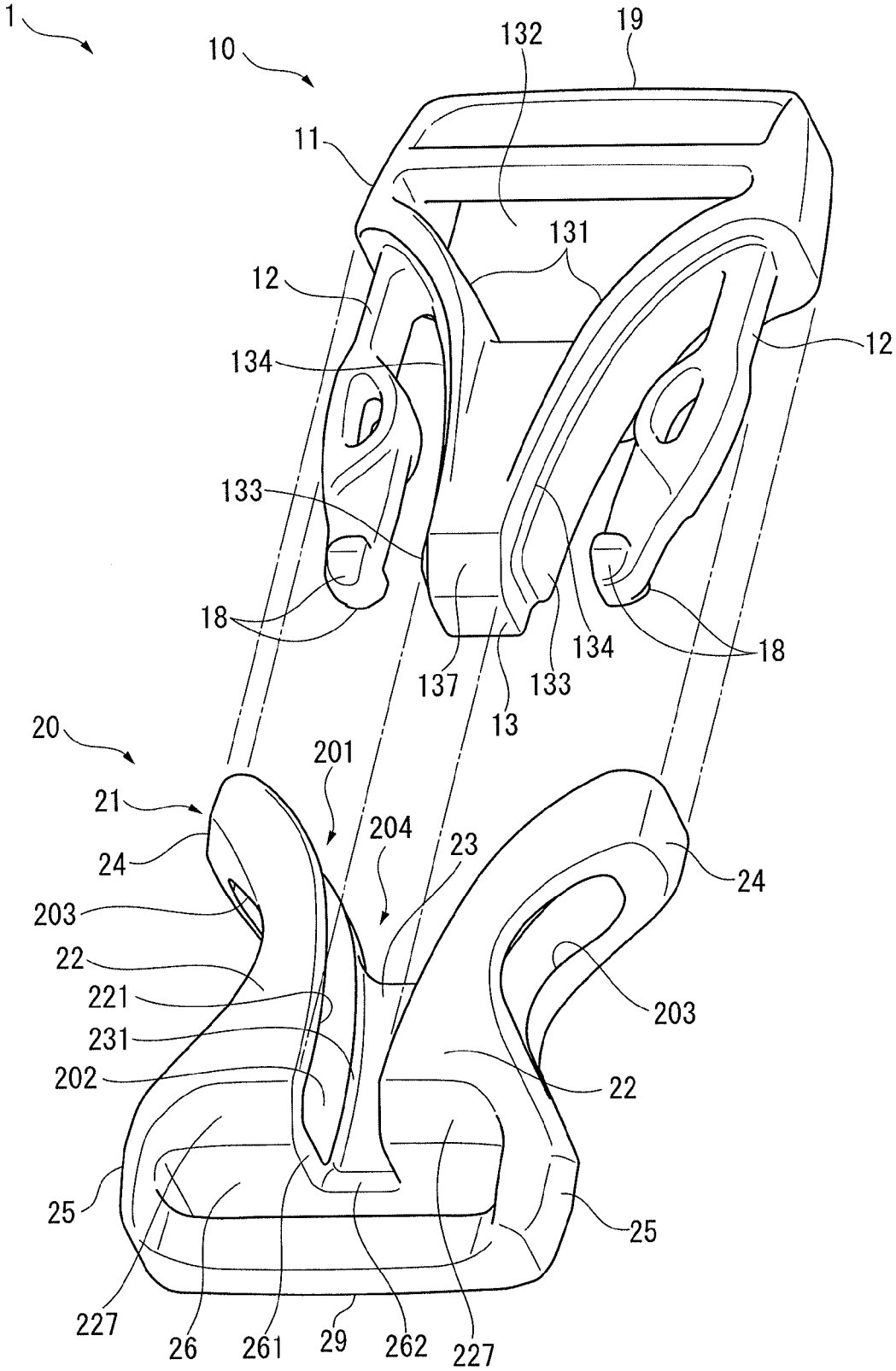

As shown in FIG. 1, a side release buckle 1 according to the exemplary embodiment includes a plug 10 and a socket 20 into which the plug 10 is to be inserted to be engaged.

The side release buckle 1 according to the exemplary embodiment is configured to fasten/unfasten a pair of belt ends (e.g., ends of different belts or both ends of a single belt) and the plug 10 and the socket 20 respectively include belt attachments 19, 29.

In the exemplary embodiment, the plug 10 and the socket 20 are each integrally formed from a synthetic resin by injection molding. Incidentally, the plug 10 and the socket 20 may be formed not from a synthetic resin but from any other material such as metal, and the injection molding may be replaced by any other molding method.

Figure 2:
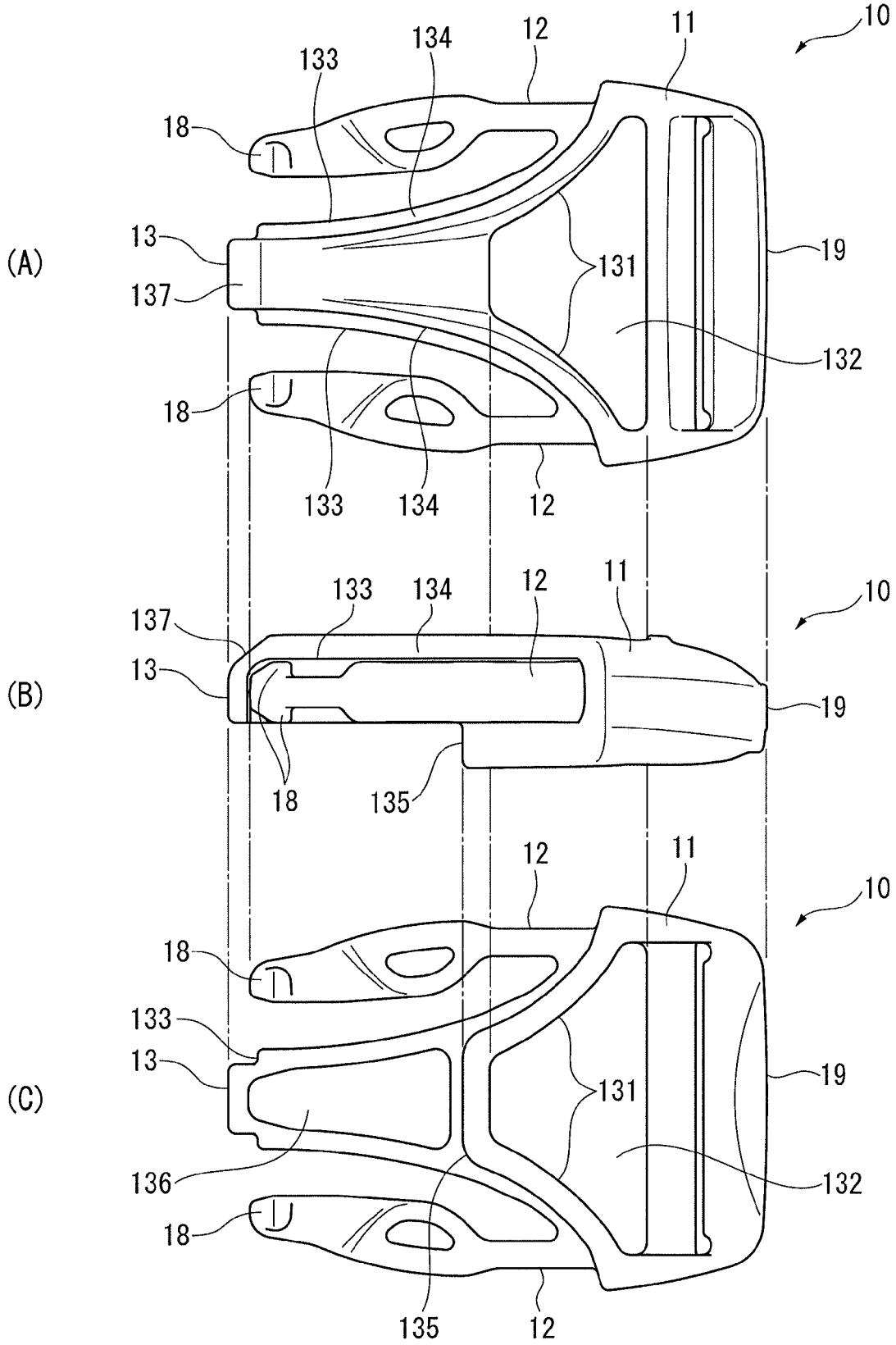
Figure 3:
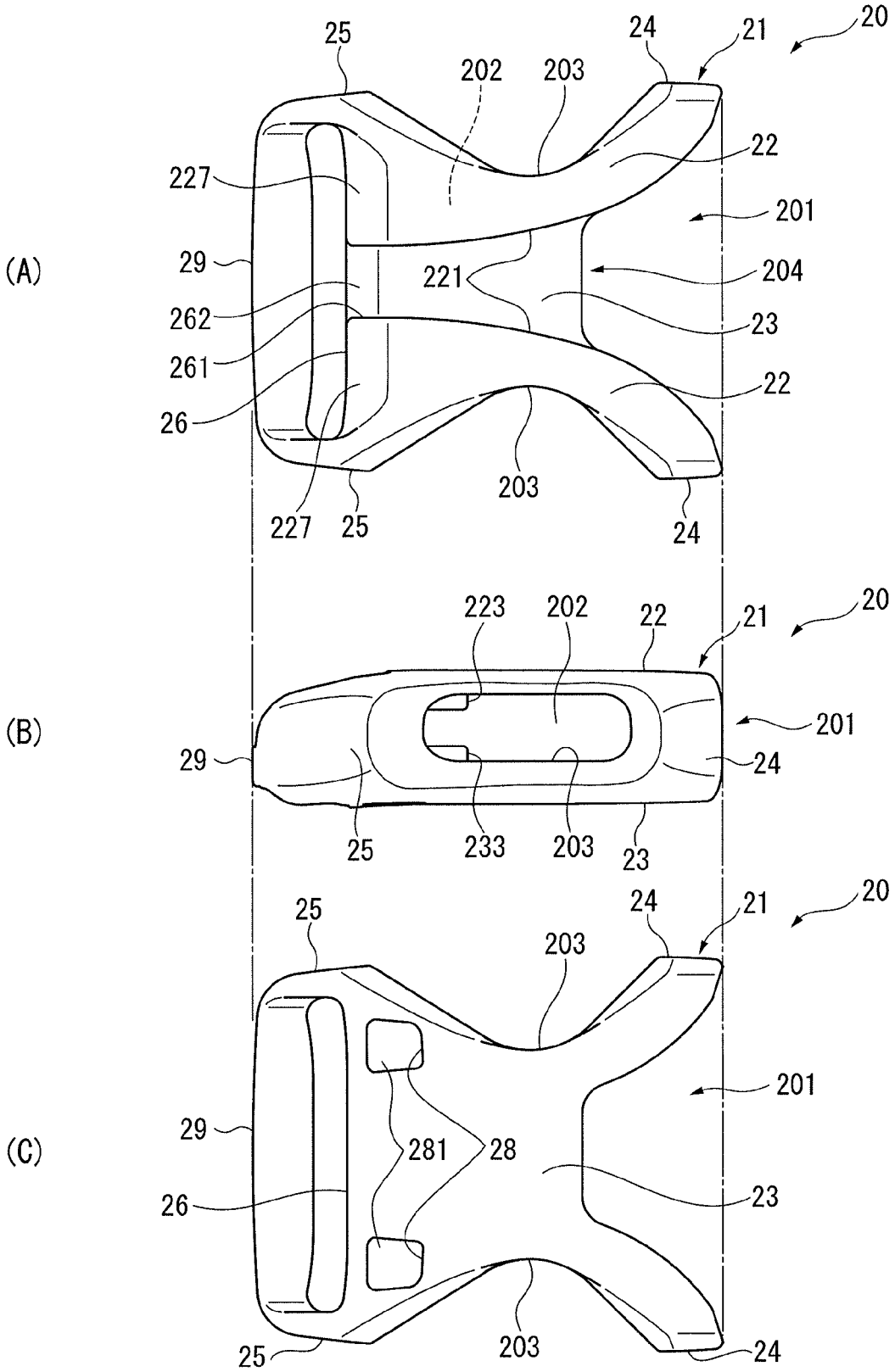

The plug 10 will be described below with reference to FIGS. 1 and 2.

The plug 10 includes a base 11 having a first end provided with the belt attachment 19 and a second end provided with a pair of lock arms 12 and a guide bar 13, and the lock arms 12 are each provided with an engagement portion 18 in the form of a protrusion.

In the exemplary embodiment, the lock arms 12 and the guide bar 13 are configured to be inserted into the socket 20 and a direction in which the lock arms 12 and the guide bar 13 extend is defined as an insertion direction of the plug 10. Similarly, a direction in which the lock arms 12 are arranged side by side is defined as a width direction of the plug 10, and a direction intersecting with the insertion direction and the width direction is defined as a thickness direction of the plug 10.

The belt attachment 19 provided to the first end of the base 11 has a belt-insertion hole and an attachment bar. A belt is inserted into the belt-insertion hole and wound around the attachment bar to be secured by a predetermined position thereof.

The engagement portions 18 protrude from distal ends of the lock arms 12 in the thickness direction of the plug 10, so that the distal ends of the lock arms 12 are in a T-shape when seen from a lateral side (see FIG. 2(B)).

When the lock arms 12 are inserted into the socket 20, the engagement portions 18 are engaged with engaged portions 28 provided inside the socket 20 (see FIGS. 3 to 6, described later in detail) to maintain the connection of the plug 10 and the socket 20.

The lock arms 12 extend side by side from the base 11 in the insertion direction and each have an elastically deformable portion defined from a middle portion to the distal end. The respective elastically deformable portions of the lock arms 12 are thus movable in the width direction(s) toward/away from each other.

Further, the lock arms 12 are widened from the middle portions toward the distal ends while being slightly curved to be closer to each other toward the distal ends. Therefore, for instance, when a user clasps the middle portions or the engagement portions 18 at the distal ends are guided in the socket 20, thereby applying a force to move the lock arms 12 closer to each other, a narrow portion of each of the lock arms 12 near the base 11 is mainly bent even though the force causing elastic deformation is received by each of the lock arms 12 as a whole.

The guide bar 13 extends between the pair of lock arms 12 from the base 11 in the insertion direction.

The guide bar 13 is in a Y-shape as a whole. A portion of the guide bar 13 toward the base 11 is branched into a pair of branch portions 131 respectively connected to lateral portions of the base 11.

An opening 132 that penetrates the plug 10 from a front surface (see FIG. 2(A)) to a back surface (see FIG. 2(C)) of the plug 10 is defined by the pair of branch portions 131 and the base 11.

As shown in FIGS. 2(A) and 2(C), the guide bar 13 has a pair of lateral surfaces each being in an arc along the entire length. Specifically, while extending along the insertion direction of the plug 10 in the vicinity of a distal end of the guide bar 13 (i.e., at a position remote from the base 11), the pair of lateral surfaces extend outward in the width direction to be spaced from each other toward the base 11. A contour of the guide bar 13 is thus in a flared shape as a whole.

Each of the outer lateral surfaces of the guide bar 13 in an arc is provided with a protrusion 133 formed along a continuing direction of the lateral surface.

As shown in FIG. 2(B), the protrusion 133 has a back surface with a peripheral portion aligned with a back surface of the guide bar 13. In contrast, the protrusion 133 has a front surface disposed with a predetermined space from a peripheral portion of a front surface of the guide bar 13. In other words, the front surface of the protrusion 133 is present at a level lower than that of the front surface of the guide bar 13. A step 134 is thus defined continuous along the peripheral portion of the front surface of the guide bar 13.

The front surface of the guide bar 13 is mostly continuous at the same level as that of the base 11. The front surface of the guide bar 13 has a distal end provided with a slant 137 (see FIGS. 2(A) and 2(B)).

In contrast, a portion of the back surface of the guide bar 13 toward the base 11 is continuous with a back surface of the base 11 and a portion toward the distal end of the guide bar 13 (i.e., a portion remote from the base 11) recedes in the thickness direction from the back surface of the base 11 to define a step 135 between the back surface of the guide bar 13 and the back surface of the base 11 (see FIG. 2(B)).

The step 135 of the back surface of the guide bar 13 is defined along a peripheral portion of the opening 132. Further, the portion of the back surface of the guide bar 13 toward the distal end of the guide bar 13 is provided with a concave 136 (see 2(C)).

The socket 20 will be described below with reference to FIGS. 1 and 3 to 6.

The socket 20 includes a body 21 into which the lock arms 12 and the guide bar 13 of the plug 10 are to be inserted. The body 21 has a first end provided with an insertion opening 201 into which the lock arms 12 and the guide bar 13 are to be inserted and a second end provided with the belt attachment 29.

In regard to the socket 20 and the body 21 according to the exemplary embodiment, a direction in which the lock arms 12 and the guide bar 13 are inserted is defined as an insertion direction, a direction in which the lock arms 12 are arranged side by side is defined as a width direction, and a direction intersecting with the insertion direction and the width direction is defined as a thickness direction.

The body 21 includes a pair of front pieces 22 defining a front surface of the body 21 and a back piece 23 defining a back surface of the body 21, the front pieces 22 and the back piece 23 facing each other with a predetermined space.

The front pieces 22 are each in the shape of a belt that extends in the insertion direction along both lateral sides of the body 21 and define a front exterior surface of the body 21.

The back piece 23 is in the shape of a plate that extends in the insertion direction and the width direction and defines a back exterior surface of the body 21.

A cavity 202 is defined between the front pieces 22 and the back piece 23 to be in communication with the insertion opening 201, so that the lock arms 12 can be received in the cavity 202 when inserted through the insertion opening 201 to connect the plug 10 and the socket 20 to each other (see FIGS. 8 to 10 or FIG. 12).

The front pieces 22 are each connected to a lateral edge of the back piece 23 by two lateral pieces 24, 25 (i.e., a pair of lateral pieces 24 are disposed toward the insertion opening 201 and a pair of lateral pieces 25 are disposed toward the belt attachment 29). A peripheral portion of each of the front pieces 22 toward the belt attachment 29 is connected to the back piece 23 via a bottom piece 26.

A slant 227 is provided between each of the front pieces 22 and the bottom piece 26 (see FIG. 3(A) and FIG. 1). The slant 227 is the same in length and inclination as the slant 137 of the distal end of the guide bar 13 of the plug 10.

The lateral pieces 24, 25 are each continuous along the insertion direction and the bottom piece 26 is continuous along the width direction. Each of the lateral pieces 24, 25 and the bottom piece 26 are thus disposed in mutually intersecting directions.

The front pieces 22 and the back piece 23 are thus connected by the lateral pieces 24, 25 and the bottom piece 26 disposed in the mutually intersecting directions, thereby ensuring the rigidity of the body 21 including the front pieces 22, the back piece 23, the lateral pieces 24, 25 and the bottom piece 26.

Operation openings 203 are provided between the lateral pieces 24, 25.

The operation openings 203, which are in communication with the cavity 202, allow the middle portions of the lock arms 12 inserted in the cavity 202 to be exposed when the plug 10 and the socket 20 are connected (FIGS. 8 to 10 or FIG. 12). The operation openings 203 allow the lock arm 12 to be externally accessible to be disengaged.

It should be noted that the operation openings 203, which are opened between the lateral pieces 24, 25 (i.e., on lateral surfaces of the body 21), are formed such that the front pieces 22 and the back piece 23 recede in a curve to allow a user to easily disengage the lock arms 12.

A slit 204 is provided between the pair of front pieces 22 (see FIG. 3(A) and FIG. 1).

The body 21 includes the pair of front pieces 22 and the back piece 23 that are continuous via the laterals pieces 24, 25, the front pieces 22 being separated from each other by the slit 204. Therefore, the body 21 has a C-shaped cross section at any position along the entire length of the body 21 in the insertion direction, the C-shaped cross section intersecting with the insertion direction (see FIGS. 5 and 6).

The slit 204 extends in the insertion direction from the insertion opening 201 to the bottom piece 26.

The bottom piece 26 is provided with a cut 261 receding from the front surface toward the back surface of the bottom piece. The cut 261 is continuous with the slit 204, so that an inner space of the body 21 is in communication with the outside of the body 21 through a large continuous opening that extends from the insertion opening 201 via the slit 204 to the cut 261.

It should be noted that the cut 261 does not reach the back surface of the bottom piece 26 and thus the bottom piece 26 is partially left as a rib 262, which is erected from the back piece 23 (FIG. 3(A) and FIGS. 4 to 6).

Due to the presence of the rib 262, two parts of the bottom piece 26, which are separated from each other by the cut 261, are connected by the rib 262 so that the bottom piece 26 is in the form of a plate continuous along the entire length of the body 21 in the width direction. The bottom piece 26 and the back piece 23 thus intersect with each other along the entire length of the body 11 in the width direction, which results in ensuring the rigidity of the back piece 23 and thus the rigidity of the body 21.

The engaged portions 28 corresponding to the engagement portions 18 of the plug 10 are arranged in two pairs (i.e., four in total) inside the body 21.

Specifically, as shown in FIG. 3(C) and FIGS. 4 to 6, a first pair of engaged portions 28 are arranged at two opposite positions on interior surfaces of the front pieces 22 and a second pair of the engaged portions 28 are arranged at two opposite positions on an interior surface of the back piece 23. The engaged portions 28, each of which include a stepped surface opposed to the bottom piece 26, are engaged with the pair of engagement portions 18 provided to the distal ends of the lock arms 12 to restrict the lock arms 12 from displacing (i.e., coming off) toward the insertion opening 201.

Incidentally, the back piece 23 is provided with through holes 281 penetrating therethrough and the engaged portions 28 of the back piece 23 are defined by interior surfaces of the through holes 281 toward the insertion opening 201.

As shown in FIG. 3(B) and FIGS. 4 to 6, guide members 223, 233 are respectively provided to the interior surfaces of the front pieces 22 and the back piece 23, the guide members 223, 233 being disposed toward the insertion opening 201 relative to the engaged portions 28.

When the lock arms 12 are inserted through the insertion opening 201 to connect the plug 10 and the socket 20, the guide members 223, 233 serve to guide the engagement portions 18 at the distal ends of the lock arms 12 so that the pair of lock arms 12 are squeezed to approach each other and thus the engagement portions 18 are engaged with the engaged portion 28.

As shown in FIG. 3(A), the front pieces 22 each have a peripheral portion 221 facing the slit 204. The peripheral portion 221 extends in the insertion direction near the bottom piece 26, and is curved in the width direction to approach the lateral pieces 24 toward the insertion opening 201. The peripheral portion 221 is thus in the shape of an arc protruding toward the slit 204 as a whole.

Figure 4:
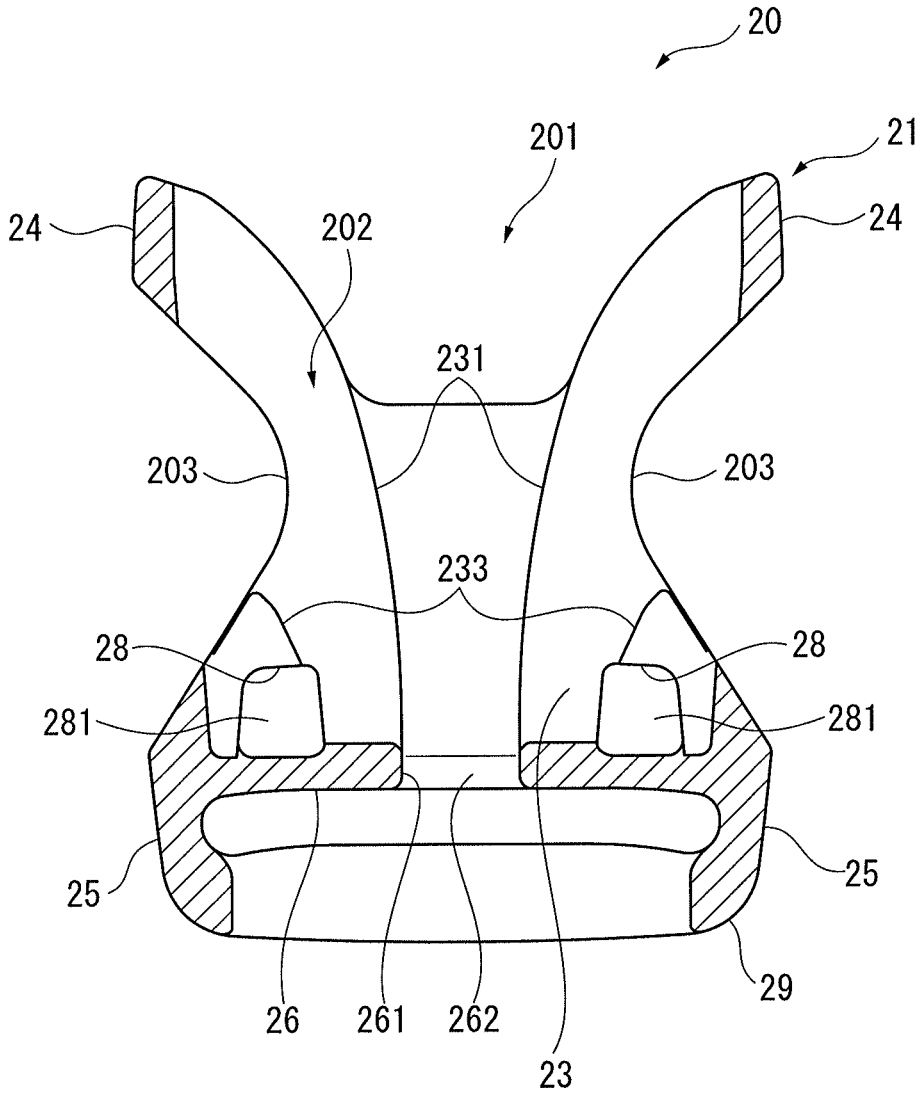
FIG. 4 shows a horizontal cross section of the socket according to the exemplary embodiment.
Figure 5:
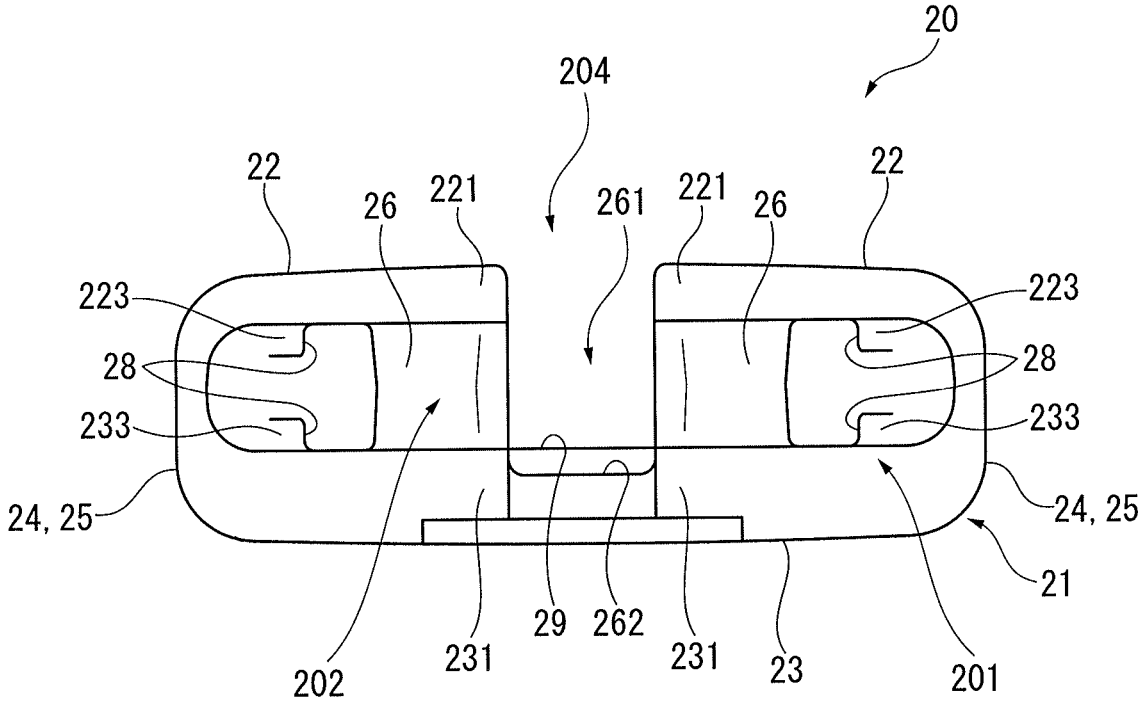
FIG. 5 shows a side of the socket according to the exemplary embodiment provided with an insertion opening.
Figure 6:
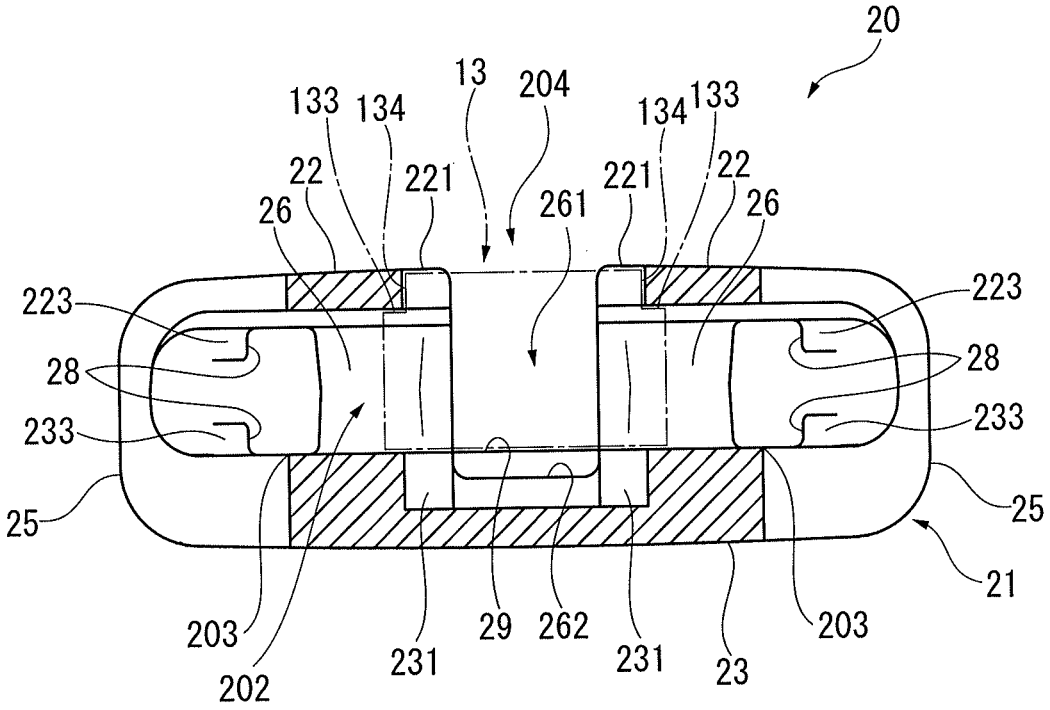
FIG. 6 is a sectional view showing a minimum-width portion of the socket according to the exemplary embodiment.

As shown in FIGS. 4 to 6, the interior surface of the back piece 23 is provided with guiding steps 231 continuously extending to the lateral pieces 24 in the form of peripheral portions in conformity with the contour of the insertion opening 201. The guiding steps 231 are each in the same arc shape as that of the peripheral portion 221 of each of the front pieces 22.

When the guide bar 13 is inserted through the insertion opening 201 to connect the plug 10 and the socket 20, the guide bar 13 is guided by the peripheral portions 221 and the guiding steps 231 to be received in an area between the peripheral portions 221 and the guiding steps 231.

An interrelation of the plug 10 and the socket 20 will be described with reference to FIGS. 7 to 10.

Figure 7:
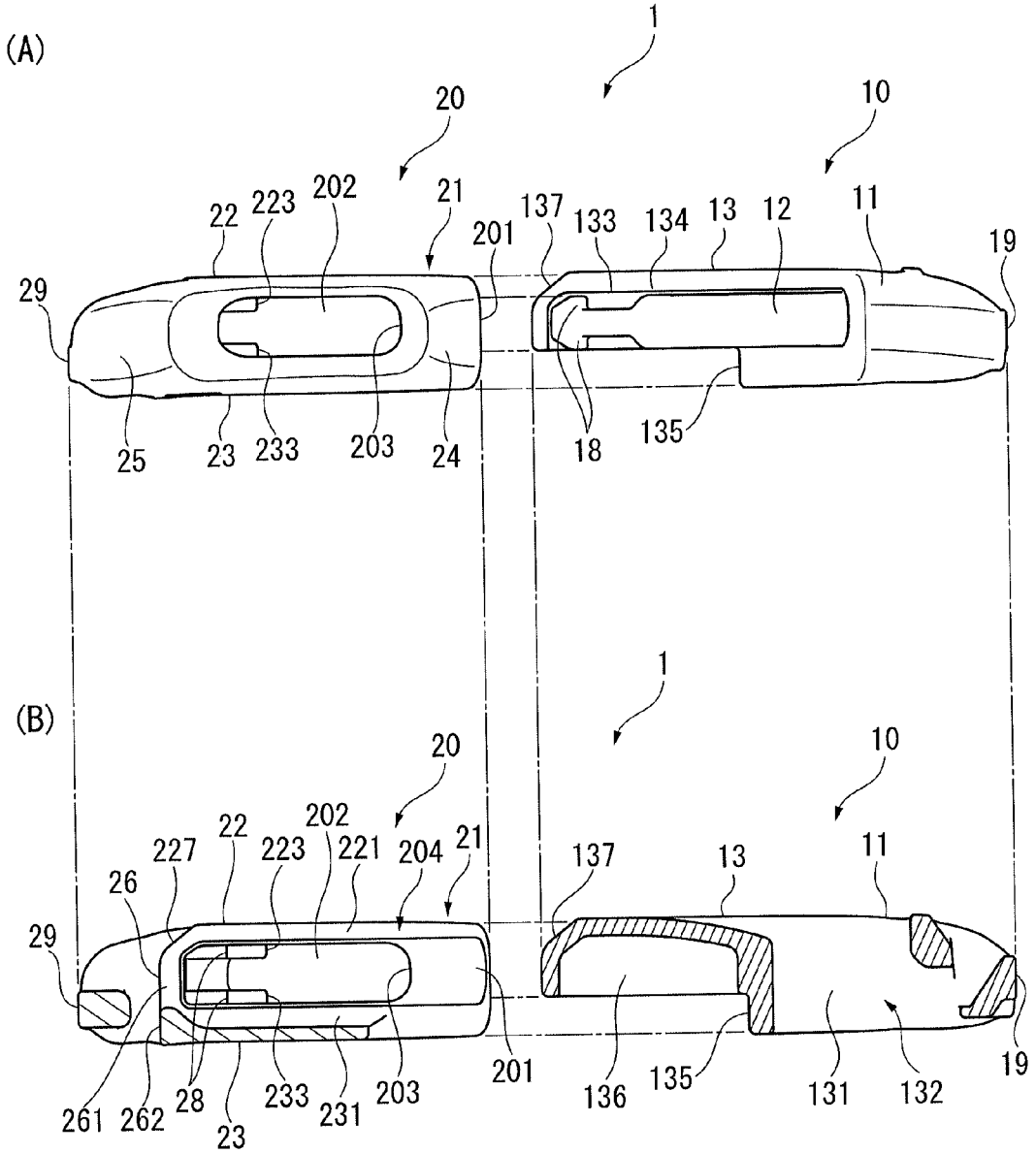
Figure 8:
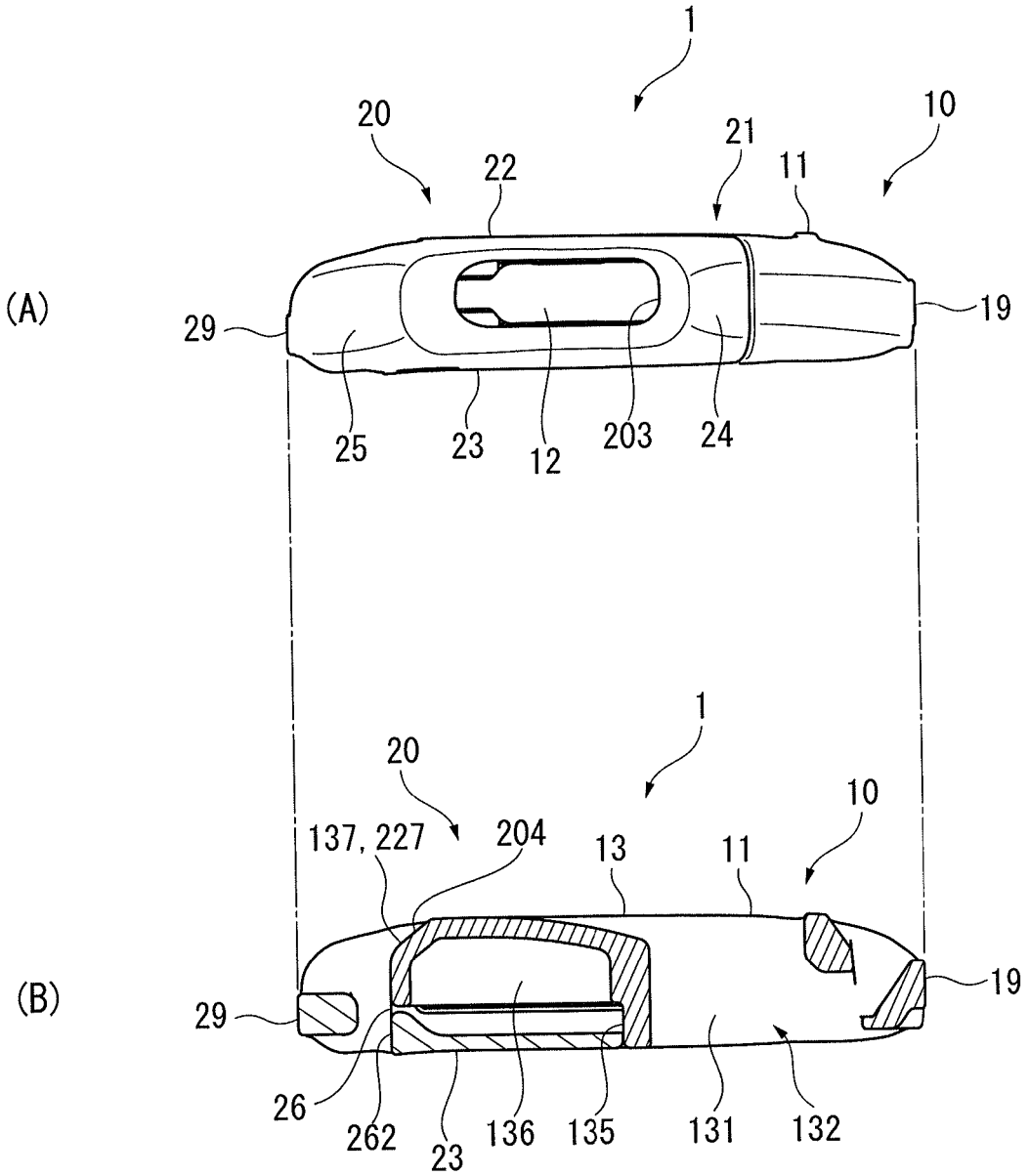

In the exemplary embodiment, the plug 10 and the socket 20 are brought opposite to each other as shown in FIG. 7 and then the plug 10 is inserted into the socket 20 to be connected as shown in FIGS. 8 to 10.

As shown in FIG. 7, a dimension of the base 11 of the plug 10 in the thickness direction is the same as a dimension of the body 21 of the socket 20 in the thickness direction (a dimension from an exterior surface of each of the front pieces 22 to an exterior surface of the back piece 23).

In the front surface of the guide bar 13 of the plug 10, a portion provided with the step 134 continuous from the distal end of the guide bar 13 to the branch portion 131 is the most thickened and an upper edge of this portion is evenly flush with a front surface of the base 11.

In contrast, due to the presence of the step 135 between the back surface of the guide bar 13 and the back surface of the base 11, the back surface of the guide bar 13 recedes from the back surface of the base 11.

As shown in FIGS. 7 and 8, when the guide bar 13 is inserted into the socket 20 through the insertion opening 201, the front surface of the guide bar 13 is guided by the pair of peripheral portions 221 and the back surface of guide bar 13 is guided by the guiding step 231 so that the guide bar 13 is received in the slit 204.

As shown in FIGS. 9 and 6, the front surface of the guide bar 13 is received in the slit 204 to close the slit 204.

Specifically, the front surface of the guide bar 13 and the exterior surface of each of the front pieces 22 are disposed at the same level to in combination define a continuous surface. Simultaneously, the peripheral portion 221 of each of the front pieces 22 is received on the step 134 of the front surface of the guide bar 13 and the protrusion 133 is received in the cavity 202 below the front pieces 22 (see a dotted line in FIG. 9). Specifically, an edge of the peripheral portion 221 abuts against a lateral surface of the guide bar 13 (i.e., a portion defined as the step 134 and absent of the protrusion 133), an interior surface (back surface) of the peripheral portion 221 abuts against a narrow front surface of the protrusion 133 (see a chain line in FIG. 6).

The guide bar 13 and each of the front pieces 22 are thus engaged with each other both in the insertion direction and in the thickness direction to be mutually restricted from displacement.

Further, when the guide bar 13 is received in the slit 204, the slant 137 of the distal end of the guide bar 13 and the slant 227 of the body 21 in combination define a continuous surface.

As shown in FIG. 10, the back surface of the guide bar 13 is introduced toward the front surface of the back piece 23 of the socket 20. It should be noted that the back surface of the base 11, which is adjacent to the back surface of the guide bar 13 across the step 135, defines a continuous surface in combination with the exterior surface of the back piece 23.

Therefore, when the plug 10 and the socket 20 are connected, the exterior surfaces of the above pieces of the socket 20 define the continuous surfaces so that the buckle 1 has a smooth appearance.

In the exemplary embodiment, the plug 10 and the socket 20 may be connected to each other after flipped over.

Figure 11:
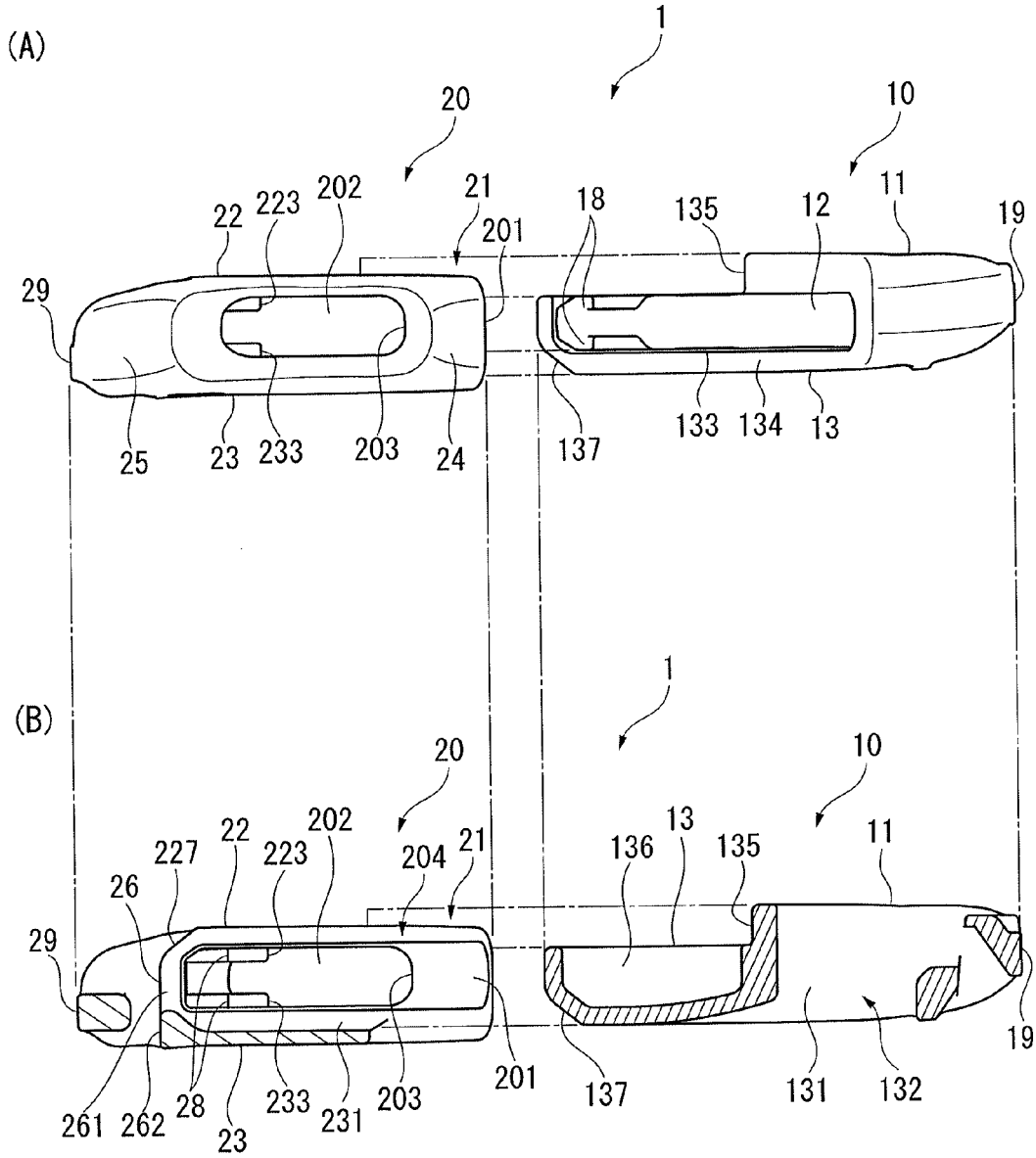
Figure 12:
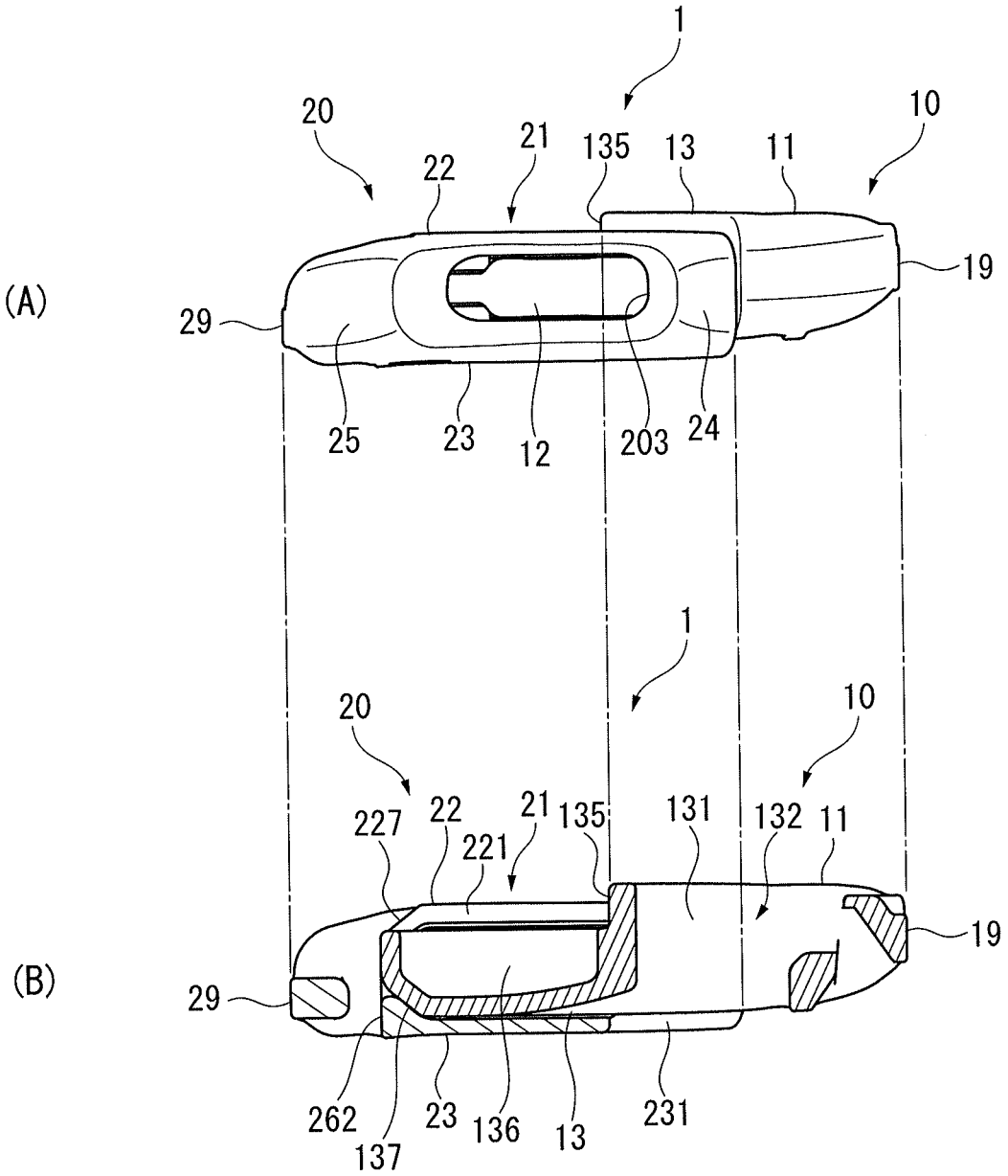

As shown in FIGS. 11 and 12, when the guide bar 13 is flipped over and inserted into the socket 20 through the insertion opening 201, the front surface of the guide bar 13 is guided by the pair of peripheral portions 221 and the back surface of guide bar 13 is guided by the guiding step 231 so that the guide bar 13 is received in the slit 204 in the same manner as described above.

As shown in FIG. 13, for instance, the concave 136 of the back surface of the guide bar 13 is exposed in the slit 204.

As shown in FIGS. 12 and 14, the step 135 of the back surface of the guide bar 13 protrudes from the exterior surface of each of the front pieces 22.

While the appearance is different due to such a protrusion, the socket 20 and the plug 10 can be connected to each other even after flipped over.

When the socket 20 and the plug 10 are flipped over and connected, the step 135 of the back surface of the guide bar 13 protrudes from the exterior surface of each of the front pieces 22 and, for instance, the concave 136 of the back surface of the guide bar 13 is exposed in the slit 204. Due to such differences in appearance, it is possible to find that the plug 10 and the socket 20 are flipped over.

As described above, in the exemplary embodiment, the socket 20 is provided with the slit 204 on a side where the front pieces 22 are provided. The slit 204 extends in the insertion direction longitudinally across the socket 20 to enhance efficiency in removing a foreign substance.

For instance, when a foreign substance enters the socket 20 through the insertion opening 201 while the plug 10 and the socket 20 are disconnected, the foreign substance may be swept out of the socket 20 along the slit 204 over the entire length in the insertion direction by moving a finger or a stick inserted in the slit 204 or applying compressed gas jetted from a nozzle (i.e., air blow).

A typical cylindrical socket is not provided with a slit extending along the entire length in an insertion direction as in the exemplary embodiment, so that a foreign substance has to be swept out in a restricted manner. In contrast, the socket 20 according to the exemplary embodiment is provided with the slit 204 extending along the entire length in the insertion direction of the body 21, so that a foreign substance can be easily and reliably removed from the entire socket 20.

In the exemplary embodiment, the lateral pieces 24, 25 (i.e., the lateral sides) serve to reliably connect the front pieces 22 to the back piece 23. Due to the arrangement of the front pieces 22, the back piece 23 and the lateral pieces 24, 25, the body 21 has a C-shaped cross section intersecting with the insertion direction of the socket 20. The body 21 has such a C-shaped cross section at any position defined in the insertion direction, so that the plug 10 can be inserted without any interference and a foreign substance can be reliably removed through the slit 204.

In the exemplary embodiment, the bottom piece 26 provided opposite to the insertion opening 201 serves to reliably connect the front pieces 22 to the back piece 23 in combination with the lateral pieces 24, 25. Specifically, the bottom piece 26 and the lateral pieces 24, 25 are arranged to define two orthogonal planes and can reliably have a rigidity required of an arrangement for connecting the front pieces 22 to the back piece 23.

In the exemplary embodiment, the bottom piece 26 is provided with the cut 261 and the slit 204 extends across the body 21 from the insertion opening 201 to the cut 261. With the slit 204 that extends longitudinally across the socket 20, a function for removing a foreign substance can be ensured.

In the exemplary embodiment, the peripheral portion 221 of each of the front pieces 22, which faces the slit 204, functions to guide the guide bar 13 abutting against the peripheral portion 221, so that the plug 10 can be smoothly inserted. Further, any other guiding arrangement is not necessitated, so that the socket 20 can be simplified in structure and reduced in weight.

In the exemplary embodiment, the peripheral portion 221 of each of the front pieces 22, which has a guiding function, defines a contour flared toward the insertion opening 201 and protruding toward the slit 204 in an arc. Therefore, the plug 10 can thus be easily inserted through the insertion opening 201 due to a favorable guiding function In the exemplary embodiment, when the plug 10 in a normal posture (i.e., in a state shown in FIGS. 7 and 8) is received in the slit 204, the front surface of the guide bar 13 defines a continuous surface in combination with the front surfaces of the front pieces 22. Therefore, while providing the guiding function as described above, the guide bar 13 closes the slit 204 when the plug 10 is connected, which results in an improved appearance of the buckle 1.

In the exemplary embodiment, the peripheral portion of the front surface of the guide bar 13 is provided with the recessed step 134, which is brought into abutment against the peripheral portion 221 of each of the front pieces 22 having the guiding function, so that the guide bar 13 exhibits the guiding function to connect the plug 10 to the socket 20. Further, when the plug 10 and the socket 20 are connected, the step 134 of the guide bar 13 is engaged with the peripheral portion 221 of each of the front pieces 22 to effectively prevent the disconnection of the buckle 1. Specifically, for instance, when an external force such as a bending force acts between the plug 10 and the socket 20, the mutually fitted step 134 and peripheral portion 221 exhibit resistivity to such an external force to enhance a bending rigidity, thereby effectively preventing the buckle 1 from being accidentally unlocked.

The other advantageous effects described in the above explanation of the exemplary embodiment can also be considered as advantageous effects of the exemplary embodiment.

Incidentally, it should be understood that the scope of the invention is not limited to the above-described exemplary embodiment(s) but includes modifications and improvements as long as the modifications and improvements are compatible with the invention.

For instance, the slant 137 of the plug 10 and the slant 227 of the socket 20 are optional according to the invention and thus may be omitted as needed.

As shown in FIG. 7(B), the socket 20 includes the bottom piece 26 that is erected from the back piece 23 to be connected to each of the front pieces 22 via the slant 227. However, a portion defined as the bottom piece 26 and the slant 227 may be modified to be in an arc or curve in side view and sectional view so as to connect the back piece 23 to each of the front pieces 22. In this case, the bottom piece 26 and the slant 227 are considered as a part of the front pieces 22 and thus the slant 137 of the guide bar 13 of the plug 10 may accordingly be modified to be in an arc or curve in conformity with the shape of the socket 20. The bottom piece 26 is only required to be a portion for connecting the back piece 23 and the front pieces 22.

The step 134 of the guide bar 13 and the peripheral portion 221 of each of the front pieces 22 optionally abut against each other according to the invention and thus, alternatively, the guide bar 13 may be entirely received beneath the peripheral portion 221 of each of the front pieces 22.

In the exemplary embodiment, the peripheral portion 221 of each of the front pieces 22 is in an arc as well as the peripheral portion of the guide bar 13 opposed to the peripheral portion 221. Specifically, the peripheral portion 221 of each of the front pieces 22 is in an arc having a small-curvature portion toward the bottom piece 26 and a larger-curvature portion toward the insertion opening 202 and the peripheral portion of the front surface of the guide bar 13 is in a similar shape having a curvature increased toward the base 11 from the distal end of the guide bar 13.

However, without departing from the scope of the invention, the above shape may be replaced by, for instance, an arc having a constant curvature, a shape that is continuously linear but partly curved, or a shape that linearly extends along the insertion direction.

FIGS. 15 and 16 show another exemplary embodiment of the invention.

As shown in the figures, a buckle 1A of this exemplary embodiment is different from the buckle 1 of the above exemplary embodiment shown in FIGS. 1 to 14 in that: the slants 137, 227 and the rib 262 are omitted; and the peripheral portion 221 of each of the front pieces 22 and the peripheral portion of the guide bar 13 opposed to the peripheral portion 221 have different shapes from the ones described above. It should be noted that the other arrangements according to this exemplary embodiment are the same as those of the above exemplary embodiment shown in FIGS. 1 to 14.

In this exemplary embodiment, while linearly extending from the bottom piece 26 toward the insertion opening 202 along the slit 204, the peripheral portion 221 of each of the front pieces 22 is sharply curved outward in the width direction of the socket 20 toward the insertion opening 201 and further linearly extends slightly to the lateral piece 24. Incidentally, a long linear portion of the peripheral portion 221 toward the bottom piece 26 is tilted relative to the insertion direction at a tilt angle that is sufficiently gentle as compared with that of a short linear portion toward the insertion opening 201.

A front surface of the guide bar 13 of this exemplary embodiment has a peripheral portion shaped in conformity with the peripheral portion 221 of each of the front pieces 22 in the same manner as in the above exemplary embodiment. The peripheral portion of the guide bar 13 is provided with the protrusion 133 and the step 134. The step 134 is brought into abutment against the peripheral portion 221 of each of the front pieces 22.

FIGS. 17 and 18 show still another exemplary embodiment of the invention.

As shown in the figures, a buckle 1B of this exemplary embodiment is different from the buckle 1 of the above exemplary embodiment shown in FIGS. 1 to 14 in that: the slants 137, 227, the rib 262, the protrusion 133 and the step 134 are omitted; the guide bar 13 has a different shape from the one described above; and the peripheral portion 221 of each of the front pieces 22 also has a different shape from the one described above. It should be noted that the other arrangements according to this exemplary embodiment are the same as those of the foregoing exemplary embodiment shown in FIGS. 1 to 14.

In the socket 20 of this exemplary embodiment, the insertion opening 20 is in the form of an opening surface defined along the width direction, the slit 204 between the front pieces 22 extends along the insertion direction from an edge of the insertion opening 202 toward the bottom piece 26, and the peripheral portion 221 of each of the front pieces 22 is thus linear along the insertion direction.

The guide bar 13 of this exemplary embodiment is in the form of a single stick projecting from the base 11 and is received in the slit 204 in the connected state. When received in the slit 204, a peripheral portion of a front surface of the guide bar 13 is opposed to the peripheral portion 221 of each of the front pieces 22 along the peripheral portion 221, so that the front surface of the guide bar 13 and the front pieces 22 in combination define a continuous surface. In other words, the step 134 of the guide bar 13 engaged with the peripheral portion 221 in the exemplary embodiment of FIG. 1 and the exemplary embodiment of FIG. 15 is not provided in this exemplary embodiment.

Similarly, in this exemplary embodiment shown in FIG. 17 as well as the above exemplary embodiment shown in FIG. 15, the socket 20 is provided with the slit 204 on the side where the front pieces 22 are provided. The slit 204 extends longitudinally across the socket 20 in the insertion direction to enhance efficiency in removing a foreign substance.

It is not necessary that the front surface of the guide bar 13 is configured to define a flush continuous surface in combination with the front pieces 22. Further, it is not necessary that the peripheral portion 221 of each of the front pieces 22 is configured to guide the guide bar 13.

The bottom piece 26 may be omitted. In this case, it is desired that a support rigidity provided by the lateral pieces 24, 25 be enhanced so that the back piece 23 and the lateral pieces 24, 25 can define the C-shaped cross section.

In the above exemplary embodiment, the side release buckle 1 including the pair of lock arms 12 is explained. However, the invention is applicable to a center lock buckle or front release buckle that includes a wide-width lock arm disposed along the back piece 23. In this case, for instance, a release button may be disposed in the slit 204 of the socket 20 with both sides of the wide-width lock arm being held by the pair of front pieces 22.

In the above exemplary embodiment(s), the lateral pieces 24, 25 and the bottom piece 26 are used to connect the pair of front pieces 22 to the back piece 23. However, as long as the rigidity of the lateral pieces 24, 25 is increased, it is not necessary to use the bottom piece 26 to support the front pieces 22 and the back piece 23 in the intersecting directions and thus the bottom piece 26 may be omitted as needed.

A single lateral piece or three or more lateral pieces may be provided in place of the two lateral pieces 24, 25. A single lateral piece may ensure a sufficient rigidity as long as the lateral piece has a length covering the entire length of the socket 20 defined in the insertion direction. When a single lateral piece with a small dimension is used, it is desired that the bottom piece 26 be used in combination.

In the above exemplary embodiment(s), for instance, the peripheral portion 221 of each of the front pieces 22, the guiding step 231 of the back piece 23, the guide members 223, 233 adjacent to the engaged portions 28, and the step 135 of the guide bar 13 are configured to provide the guiding function for connecting the plug 10 and the socket 20. However, these components may be modified or omitted as needed. The step 135 and the concave 136 provided to the back surface of the plug 10 may be omitted as needed.

The belt attachments 19, 29 may have shapes different from the ones described above in the exemplary embodiment(s). Accordingly, either one of the belt attachments 19, 29 may be configured not to be attached with a belt but to be fixed to a different article.

Additionally, the respective dimensions, shapes and materials of the components may be appropriately selected in the implementation of the invention.

The invention claimed is:

1. A buckle comprising:

a plug comprising a guide bar that extends in an insertion direction; and a socket provided with an insertion opening configured to receive the plug, the socket comprising:

a pair of front pieces disposed side by side in a width direction intersecting with the insertion direction of the plug;

a back piece disposed to face each of the front pieces; and a bottom piece disposed opposite to the insertion opening to connect the front pieces and the back piece, wherein a slit is defined between the pair of front pieces, the slit extends in the insertion direction from the insertion opening to the bottom piece, the front pieces each have a peripheral portion that faces the slit, wherein the peripheral portions abut against the guide bar when the plug is inserted into the socket, and the guide bar comprises a front surface configured to be continuous with an exterior surface of each of the front pieces when the guide bar is inserted into the slit and an end face configured to be continuous with an end face of the bottom piece when the guide bar is inserted into the slit.

2. The buckle according to claim 1, wherein the plug comprises:

a base; and a pair of lock arms that extend in the insertion direction from the base and each comprise an engagement portion, the socket defines a cavity provided between the front pieces and the back piece and configured to receive the lock arms therein, and the socket further comprises engaged portions provided to the front pieces and the back piece, the engaged portions each being engageable with the engagement portion.

3. The buckle according to claim 1, wherein the socket further comprises at least a pair of lateral pieces provided to opposite sides of the socket defined in the width direction to connect the front pieces and the back piece, the lateral pieces being continuous in the insertion direction.

4. The buckle according to claim 3, wherein the bottom piece is provided with a cut that is continuous with the slit, and the cut divides the bottom piece in the width direction into two parts, the two parts being connected to each other by a portion erected from the back piece.

5. The buckle according to claim 1, wherein a slanted surface extends from the front surface of the guide bar to the end face of the guide bar in the insertion direction and slants in a thickness direction so that a thickness of the guide bar at the front surface is greater than a thickness of the guide bar at the end face.

6. The buckle according to claim 1, wherein the peripheral portion of each of the front pieces is flared toward the insertion opening.

7. The buckle according to claim 1, wherein a step to be engaged with the peripheral portion of each of the front pieces is provided to a peripheral portion of the guide bar.

8. A buckle comprising:

a plug comprising a guide bar that extends in an insertion direction; and a socket provided with an insertion opening configured to receive the plug, the socket comprising:

a pair of front pieces disposed side by side in a width direction intersecting with the insertion direction of the plug; and a slit defined between the pair of front pieces, wherein the slit extends in the insertion direction from the insertion opening throughout a front exterior surface of a body of the socket, the front pieces each have a peripheral portion that faces the slit, wherein the peripheral portions abut against the guide bar when the plug is inserted into the socket, the guide bar comprises a front surface configured to be continuous with an exterior surface of each of the front pieces when the guide bar is inserted into the slit, the slit has a width defined in a direction intersecting with the insertion direction of the plug, the width being gradually decreased from the insertion opening in the insertion direction of the plug, and a cross section of the socket intersecting with the insertion direction is in a C-shape.

9. The buckle according to claim 8, wherein the width of the slit is gradually decreased in a region of one third or more of an entire length of the slit from the insertion opening in the insertion direction of the plug.

10. The buckle according to claim 8, wherein the width of the slit is gradually decreased over an entire length of the slit from the insertion opening in the insertion direction of the plug.

11. The buckle according to claim 8, wherein the plug comprises a pair of lock arms that extend in the insertion direction, the lock arms respectively comprise engagement portions that project in a thickness direction, the socket comprises a cavity continuous with the insertion opening and configured to receive the lock arms therein, and the front pieces respectively comprise engaged portions configured to be engaged with the respective engagement portions.

* * * * *